US006805437B2

(12) United States Patent
Yamanaka et al.

(10) Patent No.: US 6,805,437 B2
(45) Date of Patent: Oct. 19, 2004

(54) LIQUID SUPPLY SYSTEM, INK JET RECORDING HEAD, INK JET RECORDING APPARATUS AND LIQUID FILLING METHOD

(75) Inventors: Akihiro Yamanaka, Kanagawa (JP); Mitsuru Kurata, Kanagawa (JP); Yutaka Koizumi, Kanagawa (JP); Hiroyuki Maeda, Kanagawa (JP); Takeaki Shima, Kanagawa (JP); Akira Goto, Kanagawa (JP); Takeshi Kono, Kanagawa (JP); Tetsuto Kageyama, Kanagawa (JP); Itaru Watanabe, Kanagawa (JP); Hiroki Tajima, Kanagawa (JP); Yasushi Iijima, Tokyo (JP); Toshihiro Sasaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

(21) Appl. No.: 10/066,623

(22) Filed: Feb. 6, 2002

(65) Prior Publication Data

US 2003/0227520 A1 Dec. 11, 2003

(30) Foreign Application Priority Data

Feb. 9, 2001 (JP) ..... 2001-033681
Sep. 14, 2001 (JP) ..... 2001-280665

(51) Int. Cl.[7] ..... B41J 2/19; B41J 2/175
(52) U.S. Cl. ..... 347/92; 347/93
(58) Field of Search ..... 347/93, 92, 85, 347/86, 87

(56) References Cited

U.S. PATENT DOCUMENTS 5,457,485 A 10/1995 Moriyama et al. ..... 347/92
5,485,187 A 1/1996 Okamura et al. ..... 347/85
6,158,855 A 12/2000 Saikawa ..... 347/93
6,250,752 B1 6/2001 Tajima et al. ..... 347/92
6,631,982 B2 * 10/2003 Sasaki et al. ..... 347/85

FOREIGN PATENT DOCUMENTS

| | | |
|---|---|---|
| EP | 683050 | 11/1995 |
| EP | 884185 | 12/1998 |
| EP | 887190 | 12/1998 |
| EP | 1043161 | 10/2000 |

OTHER PUBLICATIONS

U.S. Published Application No. 2002/109758, dated Aug. 15, 2002.

U.S. Published Application No. 2002/113851, dated Aug. 22, 2002.

U.S. Published Application No. 2002/118249, dated Aug. 29, 2002.

U.S. Published Application No. 2002/118263, dated Aug. 29, 2002.

* cited by examiner

*Primary Examiner*—Judy Nguyen
(74) *Attorney, Agent, or Firm*—Fitzpatrick, Cella, Harper & Scinto

(57) ABSTRACT

The invention prevents drawbacks resulting from the bubble generated at the downstream side of the filter, while minimizing the waste in the ink. The recording head has a sub tank for storing ink supplied from the exterior, and a liquid chamber storing the ink supplied from the sub tank and supplying ink directly to a nozzle for ink discharge. A filter is provided between the sub tank and the liquid chamber. The liquid chamber holds ink of a predetermined amount in such a manner that the ink therein is separated by gas between the filter and the liquid chamber.

49 Claims, 19 Drawing Sheets

LIQUID SUPPLY SYSTEM, INK JET RECORDING HEAD, INK JET RECORDING APPARATUS AND LIQUID FILLING METHOD

BACKGROUND OF THE INVENTION

1. Field of the Invention

The present invention relates to an ink jet recording head, an ink jet recording apparatus employing such inkjet recording head, and a liquid supply system suitable for use therein.

2. Related Background Art

Among various recording methods in printers or the like, the ink jet recording method for forming a character or an image on a recording medium by discharging ink from a discharge port (nozzle) is widely employed in recent years because it is a non-impact recording method of now noise level capable of high-density and high-speed recording operation.

An ink jet recording apparatus is generally provided with an ink jet recording head, means for driving a carriage supporting such recording head, means for conveying the recording medium, and control means for controlling these components. An apparatus executing the recording operation under such carriage motion is called serial scan type. On the other hand, an apparatus executing the recording operation by the conveying of the recording medium only, without moving the ink jet recording head is called line type. In the ink jet recording apparatus of line type, the ink jet recording head is provided with a plurality of nozzles arranged over the entire with of the recording medium.

The ink jet recording head is provided with energy generating means for generating discharge energy to be given to the ink in the nozzle, in order to discharge therefrom an ink droplet. The energy generating means can be an electromechanical converting element such as a piezo element, an electrothermal converting element such as a heat generating resistor, an eletromagnetic wave-mechanical converting element or an electromagnetic wave-thermal converting element for converting electromagnetic wave such as electric wave or laser light into mechanical vibration or heat. Among these, a method for discharging ink droplet by thermal energy can achieve recording of high resolution because the energy generating means can be arranged at a high density. Particularly an ink jet recording head utilizing an electrothermal converting element as the energy generating means can be made compact more easily than a head utilizing the electromechanical converting element, and provides advantages of easily achieving high-density configuration and low manufacturing cost, utilizing the IC technology and the micro fabrication technology showing remarkable progress and improvement in reliability in the semiconductor area.

In the system of ink supply to the ink jet recording head, there are known so-called integral ink tank system in which an ink tank containing the ink is integrated with the ink jet recording head, so-called separated ink tank system in which the ink tank is separated from the ink jet recording head, so-called tube supply system in which the ink tank and the ink jet recording head are connected by a tube, and so-called pit-in system in which the ink tank and the ink jet recording head are provided separately but the ink jet recording head is moved to the position of the ink tank whenever required and is connected thereto for executing ink supply from the ink tank to the ink jet recording head.

When the capacity of the ink tank is increased in order to reduce the frequency of replacement thereof, the weight thereof increases. This means an increase in the weight of the carriage in the recording apparatus of serial scan type. In consideration of this fact, the ink jet recording apparatus of serial scan type requiring the ink tank of a large capacity for example for outputting a large sized recorded image often employs the tube supply system or the pit-in system. Among these, the tube supply system capable of continuous recording over a long period is often employed since, in the pit-in system, the recording operation has to be interrupted during the ink supply operation.

In the following the ink supply system of an ink jet recording apparatus of tube supply system will be explained with reference to FIG. 25.

The ink supply system shown in FIG. 25 is provided with a main tank 1204 containing ink therein, a supply unit 1205 on which the main tank 1204 is detachably mounted, and a recording head 1201 connected to the supply unit 1205 through a supply tube 1206.

The supply unit 1205 is provided therein with an ink chamber 1205*c*, which is open to the air by an air communicating port 1205*g* at the upper portion and is connected at the bottom portion to the supply tube 1206. On the supply unit 1205, there are fixed a hollow ink supply needle 1205*a* and a hollow air introducing needle 1205*b* of which lower ends are positioned in the ink chamber 1205*c* and higher ends protrude from the upper face of the supply unit 1205. The lower end of the ink supply needle 1205*a* is positioned lower than that of the air introducing needle 1205*b*.

The main tank 1204 is provided at the bottom thereof with two connector portions composed for example of rubber stoppers for closing the interior of the main tank 1204, whereby the ink tank singly has a hermetically closed structure. The mounting of the main tank 1204 to the supply unit 1205 is executed in such a manner that the ink supply needle 1205*a* and the air introducing needle 1205*b* respectively penetrate the connector portions and enter the interior of the main tank 1204. Since the lower ends of the ink supply needle 1205*a* and the air introducing needle 1205*b* are positioned as explained in the foregoing, the ink in the main tank 1204 is supplied to the ink chamber 1205*c* through the ink supply needle 1205*a* and the air is introduced into the main tank 1204 through the air introducing needle 1205*b* so as to compensate the pressure decrease resulting in the main tank 1204. When the ink is supplied into the ink chamber 1205*c* until the lower end of the air introducing needle 1205*a* is immersed in the ink, the ink supply from the main tank 1204 to the ink chamber 1205*c* is terminated.

The recording head 1201 is provided with a sub tank 1201*b* for containing ink of a predetermined amount, an ink discharge portion 1201*g* having an array of plural nozzles for ink discharge, and a flow path 1201*f* connecting the sub tank 1201*b* and the ink discharge portion 1201*g*. In the ink discharge portion 1201*g*, a face having the nozzle apertures is directed downwards, so that the ink is discharged downwards. Each nozzle in the ink discharge portion 1201*g* is provided with the aforementioned energy generating means. The sub tank 1201*b* is positioned higher than the ink discharge portion 1201*g*, and the supply tube 1206 is connected to the sub tank 1201*b*. Between the sub tank 1201*b* and the flow path 1201*f*, there is provided a filter 1201*c* having a fine mesh structure in order to prevent clogging of the nozzle resulting from the entry of fine foreign particles into the ink discharge portion 1201*g*.

The area of the filter 1201*c* is so selected that the pressure loss in the ink does not exceed a tolerance value. The pressure loss in the filter 1201*c* increases as the mesh thereof is fiber or the ink flow rate through the filter is higher, but is inversely proportional to the area thereof. Since the pressure loss tends to become higher in the recent recording head of high-speed, multi-nozzle and small recording dots, the area of the filter 1201*c* is selected as large as possible to suppress the increase in the pressure loss.

Since the nozzle in the ink discharge portion 1201*g* is open to the air and directed downwards, the interior of the recording head 1201 has to be maintained at a negative pressure relative to the atmospheric pressure in order to prevent ink leakage from the nozzle. On the other hand, an excessively large negative pressure causes entry of gas into the nozzle, whereby the nozzle becomes incapable of discharging ink. Therefore, in order to maintain a suitable negative pressure in the recording head 1201, the recording head 1201 is so positioned that the nozzle aperture face is higher, by a height H, than the ink liquid level in the ink chamber 1205*c* thereby maintaining the interior of the recording head 1201 at a negative pressure corresponding to the water head H. In this manner the nozzle can be maintained in a state filled with ink and forming a meniscus at the aperture face.

The ink discharge from the nozzle is executed by driving the energy generating means thereby pushing out the ink in the nozzle. After the ink discharge, the nozzle is filled with ink by the capillary force, from the side of the flow path 1201*f*. During the recording operation, the ink discharge from the nozzle and the ink filling into the nozzle are repeated whereby the ink is sucked from time to time from the ink chamber 1205*c* through the supply tube 1206.

As the ink in the ink chamber 1205*c* is sucked into the recording head 1201 and the ink liquid level in the ink chamber 1205*c* becomes lower than the lower end of the air introducing needle 1205*b*, air is introduced into the main tank 1204 through the air introducing needle 1205*b*. Along with this operation the ink in the main tank 1204 is introduced into the ink chamber 1205*c* whereby the lower end of the air introducing needle 1205*b* is immersed again in the ink in the ink chamber 1205*c*. Through the repetition of such operations, the ink in the main tank 1204 is supplied to the recording head 1201 along with the ink discharge therefrom.

In the sub tank 1201*b* of the recording head 1201, there are gradually accumulated gas entering the plastic material constituting the supply tube 1206 etc. and gas dissolved in the ink. In order to discharge useless gas accumulated in the sub tank 1201*b*, a gas discharge tube 1211 connected to a gas discharge pump 1211*a* is connected to the sub tank 1201*b*. However, in order to maintain the interior of the recording head 1201 at a suitable negative pressure, the discharge tube 1211 is provided with a valve 1211*b*, which is opened only in a gas discharging operation in such a manner that the pressure inside the recording head 1201 does not exceed the atmospheric pressure.

In order to eliminate viscosified ink clossing the ink discharge portion 1201*g* or a bubble generated from gas dissolved in the ink therein, the ink jet recording apparatus is usually provided with a recovery unit 1207, which is provided with a cap 1207*a* for capping the nozzle face of the recording head 1201 and a suction pump 1207*c* connected to the cap 1207*a*, and which eliminates the viscosified ink or accumulated bubble from the ink discharge portion 1201*g* by activating the suction pump 1207*c* thereby forcedly sucking the ink in the ink discharge portion 1201*g*.

In such suction recovery operation, a faster ink flow speed allows to effectively eliminate the viscosified ink and the bubble so that the cross section of the flow path 1201*f* is made small in order to increase the ink flow speed therein. On the other hand, the cross section of the filter 1201*c* is made as large as possible as explained in the foregoing, so that the flow path 1201*f* is made smaller in the cross section at the downstream side of the filter 1201*c*.

In the foregoing, there has been explained the conventional ink supply system in case of a tube supply system, but, also in the integral head tank system, separated head tank system or pit-in system, the configuration at the downstream side of the filter of the recording head is basically same as in the above-described tube supply system, and the difference lies only in the configuration of the ink supply path from the ink tank to the recording head.

However, the aforementioned conventional configuration may be unable to completely eliminate the bubbles, thereby eventually result in deterioration of the recording quality such as by discharge failure or ink dripping resulting from the bubbles.

In the following there will be explained drawbacks of the conventional configuration shown in FIG. 25, when bubbles are accumulated in the ink flow path 1201*f* at the downstream side of the filter 1201*c*.

A portion under the filter is reduced in the cross section of the ink flow path and constitutes a portion where the flow becomes stagnant even by the recording operation of the recording head, so that the bubbles tend to remain. Particularly in a recording head designed for multiple nozzles and a higher recording speed, the filter area has to be increased so that the ink stagnant portion increases in the ink flow, whereby the bubbles tend to remain under the filter. Particularly in case the filter and the ink flow path are positioned vertically with respect to the direction of gravity, the bubbles gather by the floating force under the filter. However, a filter portion in contact with the bubbles is incapable of filtering the ink, so that the effective filter area is inevitably decreased.

Also the ink flow path, having a small cross section, is clogged by a large bubble whereby the substantial flow resistance increases to hinder the required ink supply to the nozzle, thus eventually resulting in ink dripping or the like.

Also the bubbles in the ink discharge portion utilizing an electrothermal converting element as the energy generating means include those coming from the upstream side, namely those generated in ink passing through the filter, and those resulting from ink discharge, namely, after ink discharge by bubble generation in the ink, those not dissolved again in the ink at the extinction of the bubble and gradually accumulated in the ink. Such bubble gradually grows and may enter the nozzle or may clog the connecting portion between the nozzle and the ink discharge portion thereby resulting in discharge failure or ink dripping. Particularly in the vicinity of the ink discharge portion, fine bubbles tend to gather because the temperature in the vicinity of the heater rises to render re-dissolution of the bubbles into the ink difficult, whereby the bubble tends to grow to a size causing detrimental effect on the recording.

Furthermore, in the conventional configuration, since the cross section of the ink flow path is reduced, the generated bubbles in the ink flow path can be discharged by the recovery operation of the recording head, but the ink supply to the nozzle is hindered if the bubble grows so fast as to interrupt the flow path. In order to avoid such situation, it is necessary to discharge the bubble by executing the recovery operation frequency, but there results a drawback that the ink is wasted at each recovery operation.

On the other hand, if the cross section of the ink flow path is so increased as "not to interrupt the ink flow path by the bubble" or "to eliminate a portion where the ink flow tends to become stagnant", the bubble becomes easily movable so that, even if the ink is strongly sucked in the suction recovery operation, there is only sucked the ink but the bubble itself merely moves upstream in the ink flow path and cannot be discharged by suction.

Also since the filter has a fine mesh structure, when the bubbles reach and are absorbed under the filter, there is formed a meniscus by the ink in the sub tank, in the space in the mesh of the filter. As a result, the bubbles under the filter cannot pass through the filter to the upstream side but are accumulated under the filter.

A filter portion under which the bubbles are accumulated cannot pass the ink, thereby reducing the effective area of the filter and increasing the ink flow resistance, whereby the ink supply amount from the sub tank to the ink flow path and the ink supply amount from the ink flow path to the ink discharge portion become unbalanced to result in a discharge failure. Also, if the bubble accumulation in the ink supply portion and the deficient ink supply from the sub tank to the ink supply portion further proceed, the ink in the ink discharge portion may result in a fatal drawback such as the ink supply to the nozzle being impossible.

Also in case the small bubbles accumulate under the filter grow to a large bubble, such large bubble moves under the filter by the vibration of the recording head in the printing operation or the like, thereby securing, though unstably, an effective filter area for ink supply from the sub tank to the ink flow path, but, in case the small bubbles accumulated under the filter do not assemble and remain as a gathered group of small bubbles, such small bubbles stick to the filter even under the vibration of the recording head in the printing operation or the like and do not easily move, whereby the effective filter area for ink supply from the sub tank to the ink flow path becomes difficult to secure. Consequently there is encountered a situation where the ink supply to the nozzle cannot be realized.

Also, in order to avoid deterioration in the recording quality such as discharge failure or ink dripping, resulting from such bubbles, it becomes necessary to frequently repeat the recovery operation for removing the bubbles accumulating under the filter.

Such drawback is conspicuous in a recording head having a larger ink supply amount from the sub tank to the ink flow path and tending to show a larger pressure loss in the filter, namely a recording head with multiple nozzles for recording with small dots.

SUMMARY OF THE INVENTION

The object of the present invention is to provide an ink jet recording head capable of preventing drawbacks resulting from the bubbles generated at the downstream side of the filter while minimizing the waste of ink, an ink jet recording apparatus utilizing such ink jet recording head, a liquid supply system and a liquid filling method advantageously employable therein.

The above-mentioned object can be attained, according to the present invention, by a liquid supply system which is provided with a liquid supply path to a liquid holding portion holding liquid at the downstream end in the liquid supply direction, and a filter in the liquid supply path and in which the liquid can be supplied from the upstream side of the filter to the downstream side thereof in the vertical direction in the direction of gravity, the system comprising:

a member for dividing a portion of the filter in contact with the downstream side into a gas holding area and a liquid holding area;

wherein the gas held in said gas holding area is in communication with gas present between the downstream side of the filter and the liquid holding portion in the aforementioned downstream end.

In the liquid supply system of the present invention, as the downstream side of the filter secures a gas holding area for holding gas, a bubble eventually generated at the downstream side of the filter, being smaller than the gas held in the gas holding area, is eventually united with such gas. Thus it is rendered possible to avoid that the small bubbles are mixed in the liquid flow path or remain as a gathered group. Also the downstream side of the filter is divided into a gas holding area and a liquid holding area to stably secure an effective filter area, whereby the liquid supply from the upstream side of the filter can be stably executed without deficiency even when the liquid of a large amount is consumed at the downstream end of the liquid supply path.

At the downstream side of the filter, there is preferably formed a liquid connecting structure for holding the liquid, present in the downstream side of the filter, by the surface tension in the gas holding area thereby being connected across the filter with the liquid at the upstream side thereof. In this manner, the liquid smoothly moves between the upstream and downstream sides of the filter through the liquid connecting structure in case of liquid consumption at the downstream end of the liquid supply path or in case of a gas volume change in the gas holding area resulting for example from a change in the environmental temperature.

The liquid connecting structure is preferably provided in the vertical direction and is provided with a groove-shaped structure of which the upper end is in contact with the downstream face of the filter. In such case, the gap t between the groove-shaped structure and the filter is selected in a range $0 \leqq t \leqq 1.0$ mm whereby the liquid held by the groove-shaped structure is in satisfactory contact with the filter. Also in the downstream side of the filter, the liquid supply path may be composed of a cover member constituting a lateral face thereof and a main body member constituting another face and jointed to the cover member, and the groove-shaped structure may be provided at least in the cover member. In such case, the groove-shaped structure in the cover member may be formed as a projection with a slit, protruding from a joint plane of the cover member with the main body member and adapted to hold liquid by the surface tension, whereby, even if the cover member and the main body member are jointed by an adhesive, the slit of the groove-shaped structure for holding liquid can be prevented from entry of the adhesive.

Also the liquid supply path may be so constructed as to have a first liquid chamber at the upstream side of the filter and a second liquid chamber including the aforementioned gas holding area at the downstream side of the filter. In such case, it is possible to form a valve mechanism at the upstream side of the first liquid chamber or to provide the first liquid chamber with an air communicating aperture which can be opened or closed, whereby, in case the gas is accumulated in the second liquid chamber, suction is executed from the side of the second liquid chamber in a state where the valve mechanism or the air communicating aperture is closed, thereby reducing the pressure of the first and second liquid chambers to a predetermined value, and then the valve mechanism or the air communicating aperture is opened to fill the first and second liquid chambers with liquid of respectively appropriate amounts from the upstream side, even when gas is accumulated in the first and second liquid chambers to reduce the liquid amounts therein.

It is also possible to provide the liquid supply path at the downstream side of the filter with two liquid chambers. By the gas inflation or the vapor pressure increase in the second liquid chamber, the liquid therein is pushed out to the downstream end of the liquid supply path or returned to the first liquid chamber through the filter. However, an unexpected pushing out of the liquid in the second liquid chamber to the downstream end of the liquid supply path is undesirable, and the liquid in the second liquid chamber cannot return to the first liquid chamber through the filter since, in the second liquid chamber, the filter is in contact with the gas holding area. Therefore, by forming a third liquid chamber having a liquid holding portion adjacent to the gas in the gas holding area, the liquid held in the third liquid chamber can smoothly flow in the first liquid chamber through a contact portion with the filter even in case of gas inflation or vapor pressure increase in the second liquid chamber, whereby the liquid in the second liquid chamber is not unexpectedly pushed out from the downstream end of the liquid supply path. The contact area of the liquid held in the third liquid chamber with the filter can be maintained constant regardless of the liquid amount held in the third liquid chamber by providing the third liquid chamber with a desired number of liquid holding members. The liquid holding on the liquid holding member can be achieved by utilizing the surface tension of the liquid.

According to the present invention there is also provided an ink jet recording head provided with a first liquid chamber and a second liquid chamber separated by a filter and respectively containing liquid therein, and a liquid discharge portion connected directly with the second liquid chamber and adapted to discharge the liquid supplied from the second liquid chamber, in which the liquid can be supplied from the first liquid chamber to the second liquid chamber through the filter, comprising:

a member for dividing a portion of the filter in contact with the second liquid chamber into a gas holding area and a liquid holding area;

wherein the gas held in the gas holding area is in communication with the gas present in the second liquid chamber.

Also in the ink jet recording head of the present invention, since there are provided the first and second liquid chambers separated by the filter and the member for dividing the portion of the filter in contact with the second liquid chamber into the gas holding area and the liquid holding area in a state capable of liquid supply from the first liquid chamber to the second liquid chamber and the gas held in the gas holding area is in communication with the gas present in the second liquid chamber, it is rendered possible to resolve the drawbacks resulting from the bubbles generated at the downstream side of the filter as in the aforementioned liquid supply system of the present invention, thereby enabling stable ink discharge from the discharge portion.

It is thus rendered possible to prevent deterioration in the recording quality such as discharge failure or so-called ink dripping, resulting from the bubbles, and also to reduce the number of recovery operations for eliminating the bubbles accumulated under the filter.

Also a configuration in which the liquid held in the liquid holding area is in communication with the second liquid chamber whereby the liquids in the first and second liquid chambers can reversibly move enables stable liquid discharge from the discharge portion even when the gas volume in the second liquid chamber repeats inflation and contraction.

According to the present invention, there is also provided an ink jet recording apparatus comprising:

support means for supporting the aforementioned ink jet recording head of the present invention;

suction means for forcedly sucking ink in the ink jet recording head from a liquid discharge portion thereof; and a valve mechanism for opening or closing of a first liquid chamber of the ink jet recording head to or from the exterior thereof.

In the ink jet recording apparatus of the present invention, being provided with the suction means and the valve mechanism, the suction means is at first activated in a state where the valve mechanism is closed, to reduce the pressure in the ink jet recording head to a predetermined value, and then the valve mechanism is opened to fill the first and second liquid chambers with liquid of respectively appropriate amounts, even when gas is accumulated in the first and second liquid chambers to reduce the liquid amounts therein.

According to the present invention there is also provided a liquid filling method for use in a liquid supply system in which the first and second liquid chambers respectively holding liquid are separated by a filter while the liquid is held at the downstream side of the second liquid chamber in the liquid supply direction from the first liquid chamber to the second liquid chamber and gas is present in the gas holding area for separating the filter and the liquid in the second liquid chamber in a state capable of liquid supply from the upstream side of the filter to the downstream side thereof, the method comprising:

a step of closing the first liquid chamber from the exterior;

a step of executing suction from the downstream side of the second liquid chamber in a state where the first liquid chamber is closed, thereby reducing the pressure of the first and second liquid chambers; and a step, after the pressure decrease of the first and second liquid chambers, of opening the first liquid chamber to the exterior.

It is thus rendered possible to fill the first and second liquid chambers with liquid of respectively appropriate amounts, even when gas is accumulated in the first and second liquid chambers to reduce the liquid amounts therein.

DESCRIPTION OF THE PREFERRED EMBODIMENTS

Now the present invention will be clarified in detail by embodiments thereof, with reference to the accompanying drawings.

[First Embodiment]

Figure 1:
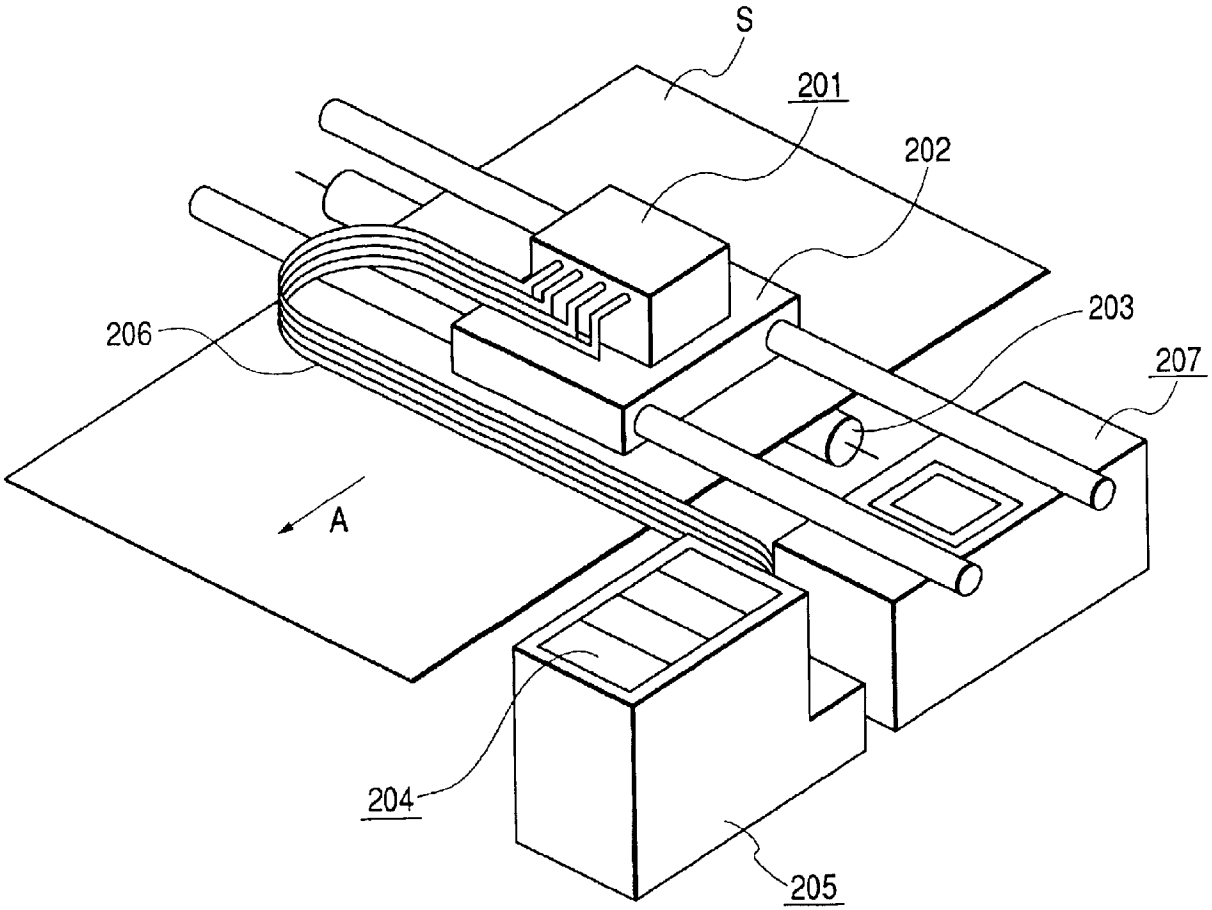
FIG. 1 is a perspective view showing the schematic configuration of an ink jet recording apparatus constituting a first embodiment of the present invention.

FIG. 1 is a perspective view showing schematic configuration of an ink jet recording apparatus constituting a first embodiment of the present invention.

The ink jet recording apparatus shown in FIG. 1 is a recording apparatus of serial type, capable of repeating the reciprocating motion (main scanning) of an ink jet head 201 and the conveying (sub scanning) of a recording sheet (recording medium) S such as an ordinary recording paper, a special paper, an OHP film sheet etc. by a predetermined pitch and causing the ink jet head 201 to selectively discharge ink in synchronization with these motions for deposition onto the recording sheet S, thereby forming a character, a symbol or an image.

Referring to FIG. 1, the ink jet head 201 is detachably mounted on a carriage 201 which is slidably supported by two guide rails and is reciprocated along the guide rails by drive means such as an unrepresented motor. The recording sheet S is conveyed by a conveying roller 203 in a direction crossing the moving direction of the carriage 202 (for example a perpendicular direction A), so as to be opposed to an ink discharge face of the ink jet head 201 and to maintain a constant distance thereto.

The ink jet head 201 is provided with plural nozzle arrays for discharging inks of respectively different colors. Corresponding to the colors of the inks discharged from the ink jet head 201, plural independent ink tanks 204 are detachably mounted on an ink supply unit 205. The ink supply unit 205 and the ink jet head 201 are connected by plural ink supply tubes 206 respectively corresponding to the ink colors, and, by mounting the main tank 204 on the ink supply unit 205, the inks of respective colors contained in the main tank 204 can be independently supplied to the nozzle arrays in the ink jet head 201.

In a non-recording area which is within the reciprocating range of the ink jet head 201 but outside the passing range of the recording sheet S, there is provided a recovery unit 207 so as to be opposed to the ink discharge face of the ink jet head 201.

Figure 2:
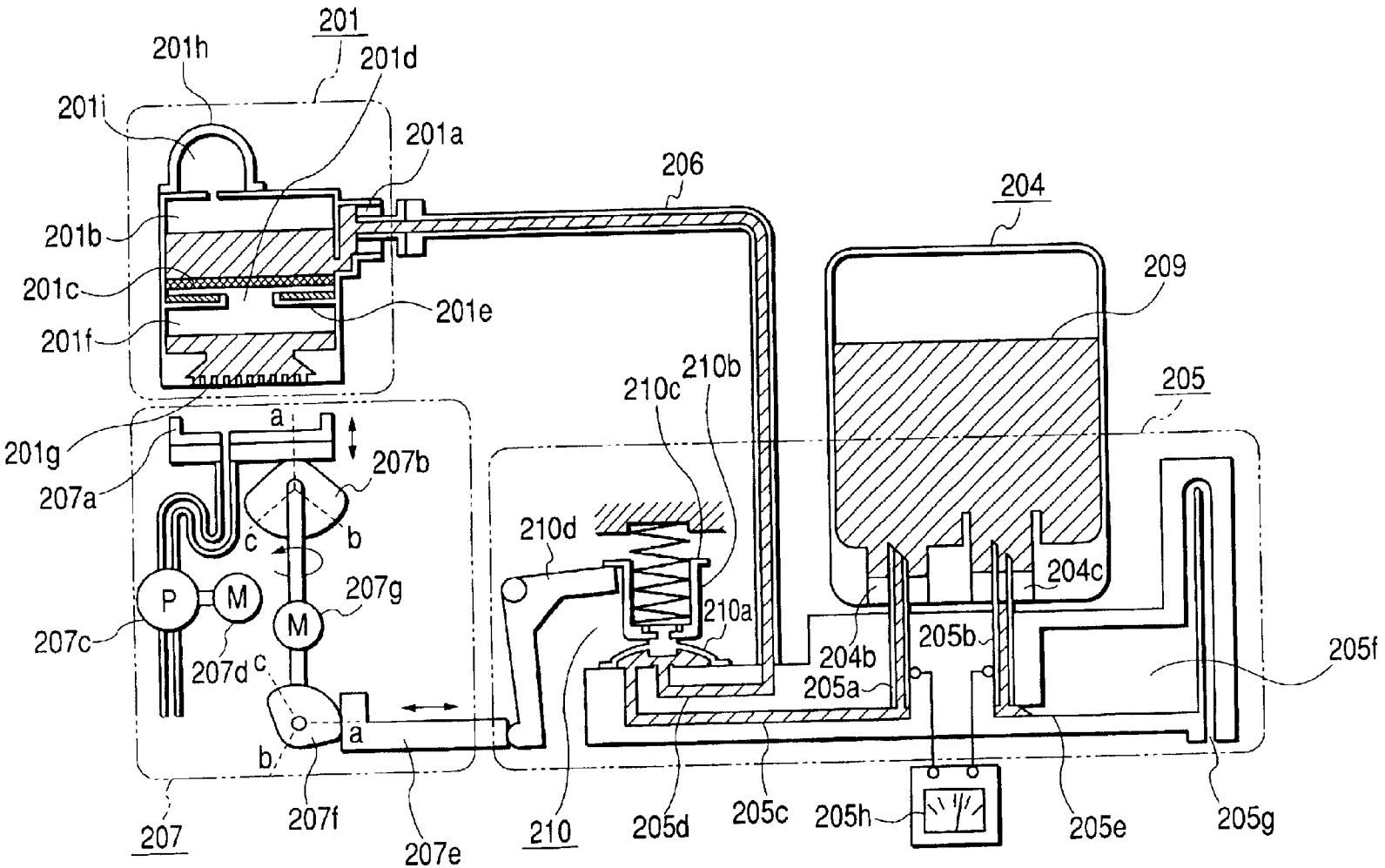
FIG. 2 is a view showing an ink supply path for a color, in the ink jet recording apparatus shown in FIG. 1.

In the following there will be explained, with reference to FIG. 2, the detailed configuration of the ink supply system of the ink jet recording apparatus. FIG. 2 is a view showing the ink supply path of the ink jet recording apparatus shown in FIG. 1, showing the path for a color for the purpose of simplicity.

At first there will be explained the recording head 201.

Ink is supplied to the recording head 201, from a connector insertion port 201*a* to which hermetically connected is a liquid connector provided on the end of the ink supply tube 206. The connector insertion port 201*a* communicates with a sub tank 201*b* formed in the upper part of the recording head 201. In the lower side of the sub tank 201*b* in the direction of gravity, there is formed a liquid chamber 201*f* for direct ink supply to a nozzle portion having plural nozzles 201*g* arranged in a parallel manner. The sub tank 201*b* and the liquid chamber 201*f* are separated by a filter 201*c*, but, at the boundary of the sub tank 201*b* and the liquid chamber 201*f* there is formed a partition portion 201*e* having an aperture 201*d*, and the filter 201*c* is provided on such partition portion 201*e*.

In the above-described configuration, the ink supplied from the connector insertion port 201*a* to the recording head 201 is supplied through the sub tank 201*b*, filter 201*c* and liquid chamber 201*f* to the nozzles 201*g*. The path between the connector insertion port 201*a* to the nozzles 201*g* is maintained in a hermetically tight condition to the atmosphere.

On the upper face of the sub tank 201*b* there is formed an aperture which is covered by a dome-shaped elastic member 201*h*. The space surrounded by the elastic member 201*h* changes volume according to the pressure in the sub tank 201*b* and has a function of adjusting the pressure in the sub tank 201*b* as will be explained later.

The nozzle 201*g* has a tubular structure of a cross-sectional width of about 20 $\mu$m and discharges ink by giving discharge energy to the ink therein, and, after the ink discharge, the interior of the nozzle is filled with ink by the capillary force thereof. Normally the ink discharge is repeated with a cycle time of 20 kHz or higher, thereby achieving fine and high-speed image formation. For supplying the ink in the nozzle 201*g* with the discharge energy, the recording head 201 is provided, in each nozzle 201*g*, with energy generation means. In the present embodiment, the energy generating means is composed of a heat generating resistor (electrothermal converting element) for heating the ink in the nozzle 201*g*, and a command from a head control unit (not shown) for controlling the drive of the recording head 201 selectively drives the heat generating resistors thereby inducing film boiling of the ink in the desired nozzle 201*g*, thereby discharging ink from the nozzle 201*g* by the pressure of a bubble formed by such film boiling.

The nozzle 201*g* is positioned with the ink discharging end (discharge port) downwards, but is not provided with a valve mechanism for opening or closing the discharge port, and the ink fills the nozzle 201*g* by forming a meniscus at the discharge port. For this purpose, the interior of the recording head 201, particularly the interior of the liquid chamber 201*f*, is maintained at a negative pressure relative to the atmospheric pressure. However, if the negative pressure is excessively small, the meniscus at the ink discharge port may be broken in case a foreign substance or ink sticks to the end of the nozzle 201*g*, whereby ink may leak from the nozzle 201*g*. On the other hand, if the negative pressure is excessively large, the force retracting the ink into the nozzle 201*g* (or liquid chamber 201*f*) becomes stronger than the energy supplied to the ink at the discharge, thereby resulting in a discharge failure. Consequently the negative pressure in the liquid chamber 201*f* is maintained within a certain range somewhat lower than the atmospheric pressure. Such negative pressure, though dependent on the number and cross section of the nozzles 201*g* and the performance of the heat generating resistor, is preferably within a range from −20 mAq (about −0.0020 atm=−0.2027 kPa) to −200 mmAq (about −0.0200 atm=−2.0265 kPa) (wherein the specific gravity of ink being assumed equal to that of water) according to the experimental results of the present inventors.

In the present embodiment, the ink supply system 205 and the recording head 201 are connected by the ink supply tube 206 and the position of the recording head 201 relative to the ink supply unit 205 can be relatively freely selected, so that the recording head 201 is positioned higher than the ink supply unit 205 in order to maintain the interior of the recording head 201 at a negative pressure. Such height will be explained later in more details.

The filter 201*c* is composed of a metal mesh having fine holes not exceeding 10 μm and smaller than the cross sectional width of the nozzle 201*g*, in order to prevent leak of a substance that may clog the nozzle 201*g*, from the sub tank 201*b* to the liquid chamber 201*f*. The filter 201*c* has such a property that, when brought into contact with liquid on one surface thereof, each fine hole forms a meniscus of the ink by the surface tension thereof, whereby the gas flow through the filter becomes difficult. As the fine hole becomes smaller, the meniscus becomes stronger and the gas flow becomes more difficult.

In such filter 201*c* as employed in the present embodiment, the pressure required for passing gas is about 0.1 atm (10.1325 pKa: experimental value). Therefore, if gas is present in the liquid chamber 201*f*, present in the downstream side of the filter 201*c* in the ink moving direction in the recording head, the gas cannot pass the filter 201*c* by the floating force of the gas itself, and the gas in the liquid chamber 201*f* remains therein. The present embodiment utilizes this phenomenon in such a manner that the liquid chamber 201*f* is not completely filled with the ink but contains a gas layer between the ink in the ink chamber 201*f* and the filter 201*c*, and the liquid of a predetermined amount is contained in the liquid chamber 201*f* in such a manner that the gas in such gas holding area separates the ink in the liquid chamber 201*f* and the filter 201*c*. The gas in such gas holding area is so present in the liquid chamber 201*f* as to inhibit bubble movement from the nozzle 201*g* to the filter 201*c*.

The minimum necessary ink amount in the liquid chamber 201*f* is an amount required for filling the nozzle 201*g* with the ink. If gas enters the nozzle 201*g* from the liquid chamber 201*f*, the nozzle 201*g* after ink discharge cannot achieve ink replenishment, thus inducing discharge failure. Consequently the interior of the nozzle 201*g* has to be always filled with the ink.

The upper surface of the filter 201*c* is in contact with the ink in the sub tank 201*b*, and the ink can communicate through the filter 201*c* only in an area where the ink on the upper surface of the filter 201*c* is in contact with that on the lower surface thereof, so that such communicable area constitutes the effective area of the filter 201*c*. As already explained in the description of the prior art, the pressure loss in the filter 201*c* depends on the effective area thereof. In the present embodiment, the filter 201*c* of a large area is positioned substantially horizontally in the operating state of the recording head 201 and the entire upper surface of the filter 201*c* is maintained in contact with the ink in order to increase the communicating area with the ink present at the lower surface of the filter, thereby maximizing the effective area thereof and reducing the pressure loss.

The pressure adjusting chamber 201*i* reduces its volume as the internal negative pressure increases, and can be composed, as in the present embodiment, of an elastic member 201*h* which is preferably composed of a rubber material or the like. The elastic member 201*h* can also be replaced by a combination of a plastic sheet and a spring. The volume of the pressure adjusting chamber 201*i*, being variable according to the ambient temperature in the operating state of the recording head 201 and the volume of the sub tank 201*b*, is selected as about 0.5 ml in the present embodiment.

In the absence of the pressure adjusting chamber 201*i*, the pressure in the sub tank 201*b* is subjected directly to the resistance by the pressure loss when the ink goes through the main tank 204, ink supply unit 205 and ink supply tube 206. Therefore, in case of so-called high-duty ink discharge operation such as ink discharge from all the nozzles 201*g*, the ink amount supplied to the recording head 201 becomes deficient relative to the discharged ink amount, whereby the negative pressure increases rapidly. If the negative pressure of the nozzle 201*g* exceeds the aforementioned limit value of −200 mmAq (about −2.0265 kPa), the discharge becomes stable and unsuitable for image formation.

In the recording apparatus of serial scan type as in the present embodiment, even in the image formation with a high duty ratio, the ink discharge is interrupted at the inversion of the drive of the carriage 202 (FIG. 1). The pressure adjusting chamber 201*i* performs a function as in a capacitor of reducing the volume during the ink discharge to relax the increase in the negative pressure in the sub tank 201*b* and restoring the volume at the inversion of the movement of the carriage.

As an example, let us consider a case where the rate of change of the negative pressure with respect to the volume reduction in the pressure adjusting chamber 201*i* is $K=-1.01325$ kPa/ml, while the sub tank 201*b* has a volume $Vs=2$ ml and the supplied ink is deficient by $\Delta V=0.05$ ml in comparison with the discharged ink. In such case, if the pressure adjusting chamber 201*i* is absent, based on the law of "PV=constant", the negative pressure in the sub tank 201*i* changes by $\Delta P=Vs/(Vs+\Delta V)-1=-2.47$ kPa, whereby the aforementioned limit value is exceeded and the discharge becomes unstable. On the other hand, in the presence of the pressure adjusting chamber 201*i*, $\Delta P=K\times\Delta V=-0.51$ whereby the increase of the negative pressure can be suppressed and the discharge can be stabilized.

As explained in the foregoing, the pressure adjusting chamber 201*i* allows to stabilize the ink discharge and to suppress the influence of the pressure loss in the ink supply path from the ink tank 204 to the recording head 201. Therefore the ink supply tube 206 moving along with the carriage 202 can also be of a smaller diameter, thus contributing to reduce the moving load of the carriage 202.

In the following there will be given an explanation on the ink supply unit 205 and the main tank 204.

The main tank 204 is constructed detachably mountable on the supply unit 205 and is provided, on the bottom portion thereof, with an ink supply aperture tightly closed with a rubber stopper 204*b* and an air introducing aperture tightly closed with a rubber stopper 204*c*. The main tank 204 is singly an air-tight container, and the ink 209 is directly contained in the main tank 204.

On the other hand, the ink supply unit 205 is provided with an ink supply needle 205*a* for deriving ink 209 from the main tank 204, and an air introducing needle 205*b* for introducing air into the main tank 204. The ink supply needle 205*a* and the air introducing needle 205*b* are both hollow needles and are positioned, with the front ends upwards, corresponding to the ink supply port and the air introducing port of the main tank 204. When the main tank 204 is mounted on the ink supply unit 205, the ink supply needle 205*a* and the air introducing needle 205*b* respectively penetrate the rubber stoppers 204*b*, 204*c*, thus entering the interior of the main tank 204.

The ink supply needle 205*a* is connected, through a liquid path 205*c*, a shut-off valve 210 and a liquid path 205*d*, to the ink supply tube 206. The air introducing needle 205*b* is connected, through a liquid path 205*e*, a buffer chamber 205*f* and an air communicating aperture 205*g*, to the external air. The liquid path 205*c* lowest in height within the ink supply path from the ink supply needle 205*a* to the ink supply tube 206 and the liquid path 205*e* highest in height within the path from the air introducing needle 205*b* to the air communicating aperture 205*g* are positioned same in height. The ink supply needle 205*a* and the air introducing needle 205*b* in the present embodiment are composed of thick needles of an internal diameter of 1.6 mm and have needle holes of a diameter of 11.5 mm in order to suppress the flow resistance of the ink.

The shut-off valve 210 is provided with a rubber diaphragm 210*a* which is displaced to open or close the connection between the two liquid paths 205*c*, 205*d*. On the upper surface of the diaphragm 210*a*, there is mounted a tubular spring holder 210*b* containing therein a compression spring 210*c* which serves to press the diaphragm 210*a* thereby closing the connection between the liquid paths 205*c*, 205*d*. The spring holder 210*b* is provided with a flange, engaging with a lever 210*d* to be operated by a link 207*e* of a recovery unit 207 to be explained later. By activating the lever 210*d* to lift the spring holder 210*b* against the spring force of the compression spring 210*c*, the connection between the liquid paths 205*c*, 205*d* is opened. The shut-off valve 210 is opened during the ink discharge from the recording head 201 but is closed during a stand-by state or in a non-operated state, and is opened and closed in synchronization with the recovery unit 207 during an ink filling operation to be explained later.

The above-described configuration of the ink supply unit 205 is provided for each main tank 204, namely for each ink color, except for the lever 210*d*. The lever 210*d* is provided common to all colors and simultaneously opens or closes the shut-off valves 210 for all the colors.

In the above-described configuration, when the ink is consumed in the recording head 201, the resulting negative pressure causes the ink to be from time to time supplied from the main tank 204 to the recording head 201 through the ink supply unit 205 and the ink supply tube 206. At this operation, air of an amount same as that of the supplied from the main tank 204 is introduced into the main tank 204 from the air communicating aperture 205*g* through the buffer chamber 205*f* and the air introducing needle 205*b*.

The buffer chamber 205*f* provides a space for temporarily holding the ink flowing out of the main tank 204 by the inflation of gas in the main tank 204, and the lower end of the air introducing needle 205*b* is positioned at the bottom of the buffer chamber 205*f*. In case the gas in the main tank 204 expands by an increase in the ambient temperature or a decrease in the external pressure during a stand-by state or a pause of the ink jet recording apparatus, since the shut-off valve 210 is closed, the ink in the main tank 204 flows out to the buffer chamber 205*f* through the air introducing needle 205*b* and the liquid path 205*e*. On the other hand, the gas in the main tank 204 contracts for example by a decrease in the ambient temperature, the ink flowing out in the buffer chamber 205*f* returns to the main tank 204. Also in case the recording head discharges ink while the ink is present in the buffer chamber 205*f*, at first the ink in the buffer chamber 205*f* returns to the main tank 204 and the gas is introduced into the main tank 204 after the ink in the buffer chamber 205*f* is depleted.

The volume Vb of the buffer chamber 205*f* is so selected as to satisfy the environmental use condition of the product. For example, for a product to be used within a temperature range of 5° C. (278K) to 35° C. (308K), and for a main tank 204 having a volume of 100 ml, the volume Vb is selected as 100×(308−278)/308=9.7 ml or larger.

Now there will be explained, with reference to FIGS. 3A to 3D, the basic water head of the main tank 204 and the behavior of gas and ink in the liquid path of the ink supply unit 205 at the gas introduction into the main tank 204.

Figure 3A:
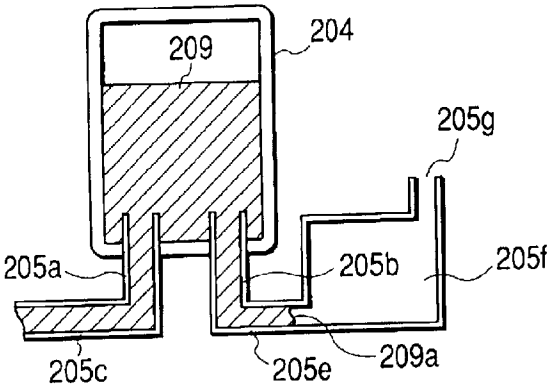
FIGS. 3A, 3B, 3C and 3D are views showing the behavior of gas and ink in the liquid path of an ink supply unit, in case of gas introduction into a main tank in the ink supply path shown in FIG. 2.

FIG. 3A shows a normal state capable of ink supply from the main tank 204 to the recording head 201 (cf. FIG. 2). In this state, the interior of the main tank 204 is maintained air-tight except for the buffer chamber 205*f* and is maintained at a negative pressure relative to the atmospheric pressure, and the front end 209*a* of the ink remains in the liquid path 205*e*. The front end of the ink is in contact with air and is therefore at the atmospheric pressure (=0 mmAq). The liquid path 205*c* in which the front end 209*e* of the ink is positioned and the liquid path 205*e* communicating with the ink supply tube 205 (cf. FIG. 2) are of a same height and mutually communicate only through the ink, so that the pressure of the liquid path 205*e* is also the atmospheric pressure. This pressure is determined only by the height relationship of the front end 209*a* of the ink and the liquid path 205*c* and is influenced by the amount of ink 209 in the main tank 204.

Figure 3B:
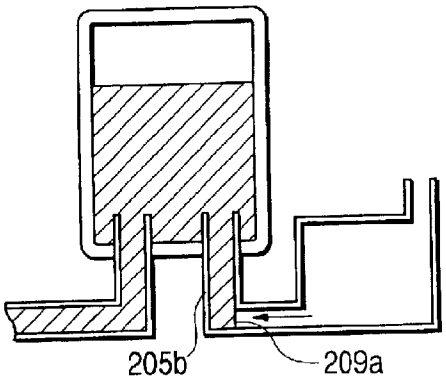
Figure 3C:
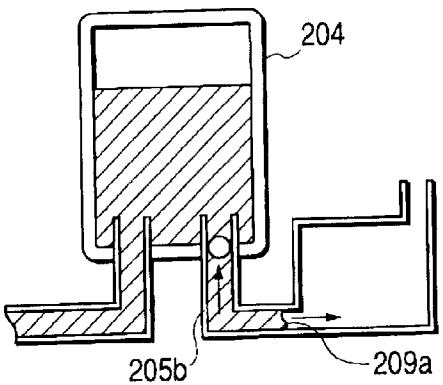

As the ink in the main tank 204 is consumed, the front end 209*a* of the ink gradually move toward the air introducing needle 205*b* as shown in FIG. 3B, and, upon reaching a position directly below the air introducing needle 205*b*, the air floats as a bubble in the air introducing needle 205*b* as shown in FIG. 3C and introduced into the main tank 204. In return, the ink in the main tank 204 enters the interior of the air introducing needle 205*b*, whereby the front end 209*a* of the ink returns to the original state shown in FIG. 3A.

Figure 3D:
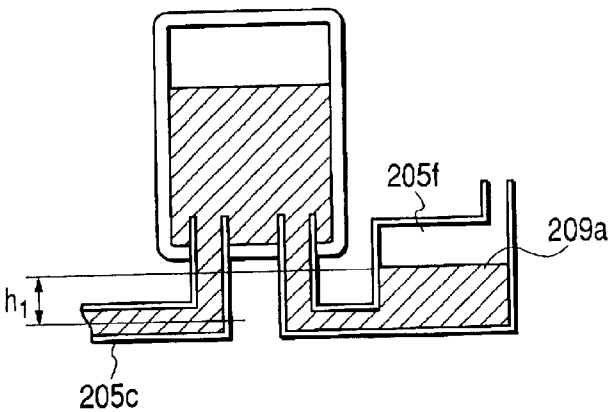

FIG. 3D shows a state where ink is accumulated in the buffer chamber 205*f*. In this state, the front end 209*a* of the ink is at a position in the middle of the height of the buffer chamber 205*f* and higher than the liquid path 205*c* by h1 (mm) so that the pressure in the liquid path 205*c* is −h1 (mmAq).

Figure 4:
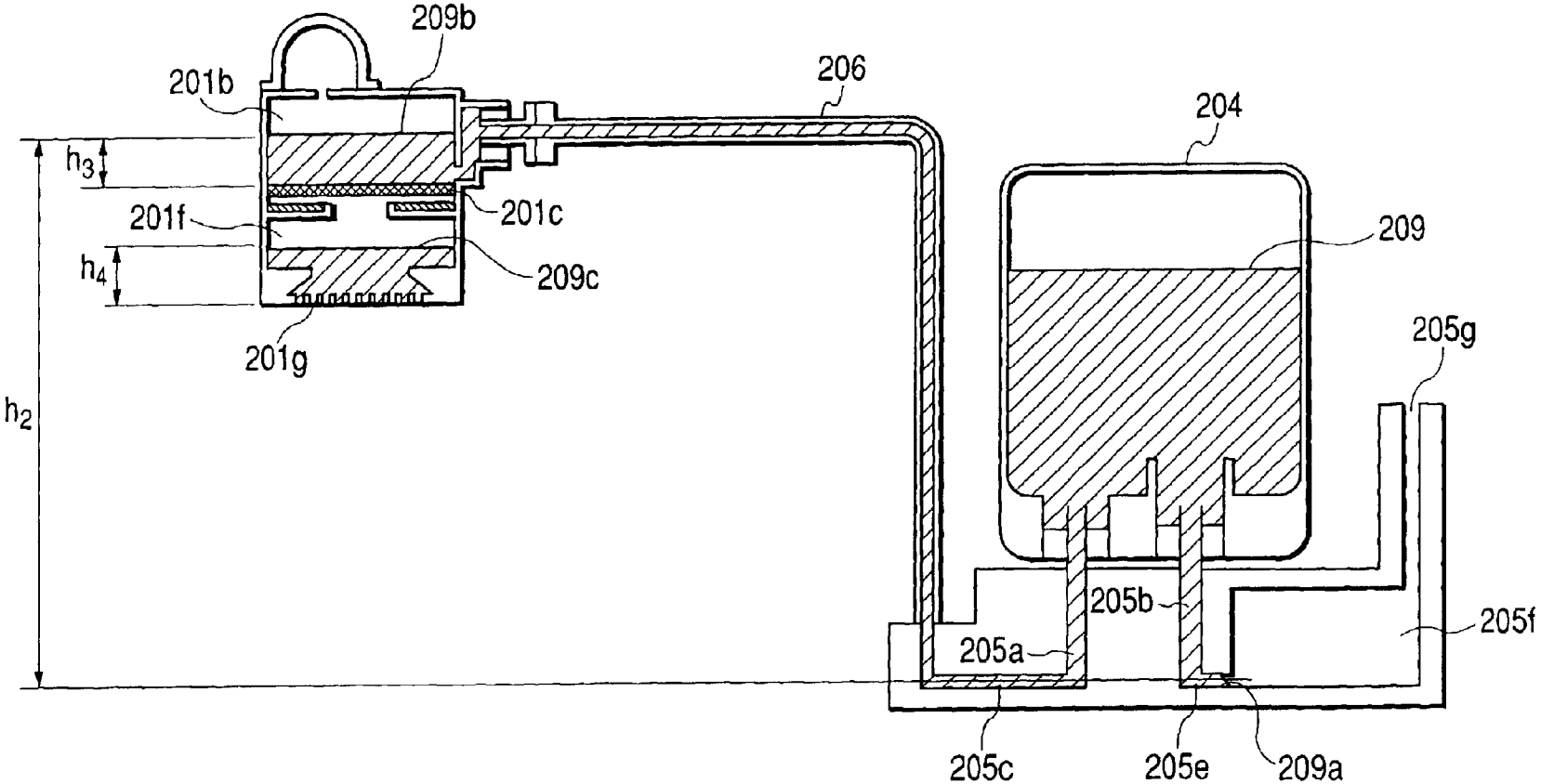
FIG. 4 is a view showing a pressure formed by a water head on the nozzle, in the ink supply path shown in FIG. 2.

Thus, in the present embodiment, the negative pressure Pn applied to the lower end of the nozzle 201*g* (cf. FIG. 2) by the water head is Pn≃−9.8×(h2−h3−h4)Pa in the normal state or −9.8×(h2−h1−h3−h4)Pa in a state where the ink is accumulated in the buffer chamber 205*f*, wherein h2 (mm) is the height from the liquid path 205*c* to the upper face 209*b* in the sub tank 201*b* as shown in FIG. 4, h3 (mm) is the height from the filter 201*c* to the upper face 209*b* in the sub tank 201*b* and h4 (mm) is the height from the lower end of the nozzle 201*g* to the upper face 209*c* in the liquid chamber 201*f*. The value Pn is so selected as to be contained within the aforementioned negative pressure range of (−0.2027 to −2.0265 kPa).

Again referring to FIG. 2, the ink supply needle 205*a* and the air introducing needle 205*b* are connected to a circuit 205*h* for measuring the electrical resistance of the ink, thereby detecting the presence or absence of ink in the main tank 204. The circuit 205*h* detects an electrically closed state in the presence of ink in the main tank 204 since a current flows in the circuit 205*h* through the ink in the main tank 204, but an electrically open state in the absence of ink or in case the main tank 204 is not mounted. Since the detected current is very weak, the insulation between the ink supply needle 205*a* and the air introducing needle 205*b* is important. In the present embodiment, the path from the ink supply needle 205*a* to the recording head 201 is made completely independent from the path from the air introducing needle 205*b* to the air communicating aperture 205*g*, whereby it is rendered possible to measure the electrical resistance of the ink only in the main tank 204.

In the following there will be given an explanation on the recovery unit 207.

The recovery unit 207 serves to suck ink and gas from the nozzle 201*g* and to operate the shut-off valve 210, and is provided with a suction cap 207*a* for capping the ink discharge face (containing aperture of the nozzle 201*g*) of the recording head 201, and a link 207*e* for operating the lever 210*d* of the shut-off valve 210.

The suction cap 207*a* is composed of an elastic member such as of rubber at least in a portion coming into contact with the ink discharge face, and is rendered movable between a position for tightly closing the ink discharge face and a position retracted from the recording head 201. The suction cap 207*a* is connected to a tube having a suction pump 207*c* of tube pump type in an intermediate position thereof, and is capable of continuous suction by activating the suction pump 207*c* by a pump motor 207*d*. It is also possible to vary the suction amount by changing the revolution of the pump motor 207*d*. The present embodiment employs a suction pump 207*c* capable of reducing pressure to −0.8 atm (81.060 kPa).

A cam 207*b* for activating the suction cap 207*a* is rotated by a cam control motor 207*g*, in synchronization with a cam 207*f* for operating the link 207*e*. The timing of the cam 207*b* coming into contact with the suction cap 207*a* in the positions a to c corresponds to the timing of the cam 207*f* coming into contact with the link 207*e* in the positions a to c. In the position a, the cam 207*b* separates the suction cap 207*a* from the ink discharge face of the recording head 201, and the cam 207*f* presses the link 207*e* to elevate the lever 210*d*, thereby opening the valve 210. In the position b, the cam 207*g* brings the suction cap 207*a* in contact with the ink discharge face, and the cam 207*f* pulls back the link 207*e* to close the valve. In the position c, the cam 207*b* brings the suction cap 207*a* in contact with the ink discharge face, and the cam 207*f* presses the link 207*e* to open the valve.

In the recording operation, the cams 207*b*, 207*f* are maintained in a state of the position a to enable ink discharge from the nozzle 201*g* and ink supply from the main tank 204 to the recording head 201. In a non-operating state including a stand-by state and a pause, the cams 207*b*, 207*f* are maintained in a state of the position b to prevent drying of the nozzle 201*g* and ink flow-out from the recording head 201 (particularly in case the apparatus itself is moved, the apparatus may be inclined to induce ink flow-out). The position c of the cams 207*b*, 207*f* is employed in an ink filling operation to the recording head 201 to be explained later.

In the foregoing there has been explained the ink supply path from the main tank 204 to the recording head 201, but the configuration shown in FIG. 2 eventually results in gas accumulation in the recording head 201 over a prolonged period.

In the sub tank 201*b*, there are accumulated gas permeating through the ink supply tube 206 and the elastic members 201*h*, and gas dissolved in the ink. The gas permeating through the ink supply tube 206 and the elastic member 201*h* can be prevented by employing a material of high gas barrier property, but such material is expensive. In the mass produced consumer equipment, it is not easy to use expensive material in consideration of the cost. In the present embodiment, the ink supply tube 206 is composed of a polyethylene tube of low cost and high flexibility, and the elastic member 201*h* is composed of butyl rubber.

On the other hand, in the liquid chamber 201*f*, there is gradually accumulated gas, because of a phenomenon that the bubble generated in the ink discharge from the nozzle 201*g*, namely the bubble generated in the ink in the nozzle 201*g* in the recording operation but thereafter not re-dissolved in the ink at the contraction of the bubble and returning to the liquid chamber 201*f*, or a phenomenon that the fine bubbles present in the ink gather to form a larger bubble by an increase of the ink temperature in the nozzle 201*g*.

According to the experiment of the present inventors, in the configuration of the present embodiment, the gas accumulates by about 1 ml/month in the sub tank 201*b* and about 0.5 ml/month in the liquid chamber 201*f*.

The gas accumulation in the sub tank 201*b* and the liquid chamber 201*f* reduces the ink amount therein. In the sub tank 201*b*, an ink deficiency causes exposure of the filter 201*c* to the gas to reduce the effective area thereof, thereby increasing the pressure loss thereof and eventually disabling ink supply to the liquid chamber 201*f*. Also an ink deficiency in the liquid chamber 201*f* causes exposure of the upper end of the nozzle 201*g* to the gas, thereby rendering ink supply thereto impossible. In this manner, a fatal situation arises unless each of the sub tank 201*b* and the liquid chamber 201*f* contains ink at least equal to a predetermined amount.

Therefore, by filling each of the sub tank 201*b* and the liquid chamber 201*f* with an appropriate amount of ink at a predetermined interval, the ink discharging performance can be stably maintained over a long period, even without employing the material of high gas barrier property. For example, in the present embodiment, the sub tank 201*b* and the liquid chamber 201*f* may be filled with ink every month by an amount equal to the accumulating gas amount per month plus fluctuation in the filling.

The ink filling into the sub tank 201*b* and the liquid chamber 201*f* is executed utilizing the suction operation by the recovery unit 207. More specifically, the suction pump 207*c* is activated in a state where the ink discharge face of the recording head 201 is tightly closed by the suction cap 207*a*, thereby sucking the ink in the recording head 201 from the nozzle 201*g*. However, in simple ink suction from the nozzle 201*g*, ink of an amount approximately equal to the ink sucked from the nozzle 201*g* flows from the sub tank 201*b* into the liquid chamber 201*f* and ink of an amount approximately equal to that flowing out of the sub tank 201*b* flows from the main tank 204 into the sub tank 201*b*, so that the situation does not change much from the state prior to suction.

Therefore, in the present embodiment, in order to fill the sub tank 201*b* and the liquid chamber 201*f* separated by the filter 201*c* respectively with appropriate amounts of ink, the sub tank 201*b* and the liquid chamber 201*f* are reduced to a predetermined pressure utilizing the shut-off valve 210, thereby setting the volumes of the sub tank 201*b* and the liquid chamber 201*f*.

In the following there will be explained the ink filling operation of the sub tank 201*b* and the liquid chamber 201*f*, and the volume setting thereof.

In the ink filling operation, at first the carriage 202 (cf. FIG. 1) is moved to a position where the recording head 120 is opposed to the suction cap 207*a*, and the cam control motor 207*g* of the recovery unit 207 is activated to rotate the cams 207*b*, 207*f* to a state where the position b for respective contacts with the suction cap 207*a* and the link 207*e*. Thus the ink discharge face of the recording head 201 is closed by the suction cap 207*a*, and the shut-off valve 210 closes the ink path from the main tank 204 to the recording head 201.

The pump motor 207*d* is activated in this state to execute suction by the suction pump 207*c* from the suction cap 207*a*. This suction operation sucks ink and gas, remaining in the recording head 201, through the nozzle 201*g*, thereby reducing the pressure in the recording head 201. The suction pump 207*c* is stopped when the suction reaches a predetermined amount, and the cam control motor 207*g* is activated to rotate the cams 207*b*, 207*f* to a state where the position c in contact with the suction cap 207*a* and the link 207*e*. Thus the ink discharge face remains in the closed state by the suction cap 207*a* but the shut-off valve 210 is opened. The suction amount of the suction pump 207*c* is so selected as to bring the interior of the recording head 201 to a predetermined pressure required for filling the sub tank 201*b* and the liquid chamber 201*f* with ink of appropriate amounts, and can be determined by calculation or by experiment.

As the internal pressure of the recording head 201 is reduced, ink flows into the recording head 201 through the ink supply tube 206, thereby filling each of the sub tank 201*b* and the liquid chamber 201*f* with ink. The amount of ink filling corresponds to a volume required for returning the sub tank 201*b* and the liquid chamber 201*f* to the atmospheric pressure, and is determined by the volume and pressure thereof.

The ink filling into the sub tank 201*b* and the liquid chamber 201*f* is completed in about 1 second after opening the shut-off valve 210. Upon completion of the ink filling, the cam control motor 207*g* is driven to rotate the cams 207*g*, 207*f* to a state where the position a is in contact with the suction cap 207*a* and the link 207*e*. In this manner the suction cap 207*a* is separated from the recording head 201, and the suction pump 207*c* is activated again to suck the ink remaining in the suction cap 207*a*. As the shut-off valve 210 is open in this state, the recording head 201 can discharge ink to form a character or an image on the recording sheet S (cf. FIG. 1). In a stand-by state or in a pause, the cam control motor 207*g* is activated again to rotate the cams 207*b*, 207*f* to a state where the position b is in contact with the suction cap 207*a* and the link 207*e*, thereby closing the ink discharge face of the recording head 201 with the suction cap 207*a* and closing the shut-off valve 210.

Unless the ink in the sub tank 201*b* and the liquid chamber 201*f* becomes deficient over a long period, it is not necessary to frequently execute the suction operation by the recovery unit 207, so that the chances of wasting ink can be reduced. Also the ink filling, if required in both of the sub tank 201*b* and the liquid chamber 201*f*, can be achieved in a single filling operation, thereby allowing to economize the ink.

Now, let us consider the relationship among the volume V1 of the sub tank 201*b*, the ink amount S1 to be filled therein and the pressure P1 (relative to the atmospheric pressure) therein. Based on the law "PV=constant", the sub tank 201*b* can be filled with the ink of an appropriate amount in the filling operation, by setting a relation $V1=S1/|P1|$. Similarly, for the volume V2 of the liquid chamber 201*f*, the ink amount S2 to be filled therein and the pressure P2 (relative to the atmospheric pressure) therein, the liquid chamber 201*f* can be filled with the ink of an appropriate amount in the filling operation, by setting a relation $V2=S2/|P2|$.

Also the filter 201*c* separating the sub tank 201*b* and the liquid chamber 201*f* has a fine mesh structure and the gas flow therein is difficult in a state having a meniscus therein, as explained in the foregoing. For a pressure Pm required for gas permeation through the filter 201*c* having such meniscus, in case of suction from the nozzle 201*g* by the recovery unit 207, the pressure P2 in the liquid chamber 201*f* becomes lower by Pm than the pressure P1 in the sub tank 201*b* since the gas has to come from the sub tank 201*f* through the filter 201*c*. Thus, by employing this relationship in determining the volumes of the sub tank 201*b* and the liquid chamber 201*f*, the condition of the filling operation can be easily determined.

In the following there will be explained specific examples of the aforementioned filling operation and the volume setting.

It is assumed that the ink filling is executed every month, and the gas accumulating amount per month is 1 ml in the sub tank 201*b* and 0.5 ml in the liquid chamber 201*f*. It is also assumed that the ink amount required in the sub tank 201*b* not to expose the filter 201*c* to gas is 0.5 ml while the ink amount required in the liquid chamber 201*f* not to expose the nozzle 201*g* to gas is 0.5 ml, and the fluctuation in the ink filling amount is 0.2 ml both in the sub tank 201*b* and the liquid chamber 201*f*. Thus the ink amount to be filled in a single filling operation is the sum of these amounts, and is 1.7 ml in the sub tank 201*b* and 1.2 ml in the liquid chamber 201*f*.

The reduced pressure in the recording head 201 is selected within the ability of the recovery unit 207. In the present embodiment, since the power limit of the suction pump 207*c* is −0.8 atm (81.060 kPa), the suction amount of the suction pump 207*c* is experimentally so determined that the pressure in the suction cap 207*a* can reach −0.5 atm (−50.6625 kPa) with a margin, and is controlled by the revolution of the pump motor 207*d*.

As the pressure required for gas permeation against the meniscus in the nozzle 201*g* is experimentally −0.05 atm (−5.06625 kPa), there is generated a difference between the pressures of the suction cap 207*a* and the liquid chamber 201*f* by the resistance of the nozzle 201*g*, whereby the pressure in the liquid chamber 201*f* becomes higher than that in the suction cap 207*a* by 0.05 atm (5.06615 kPa). Similarly, as the pressure required for gas permeation against the meniscus in the filter 201*c* is experimentally −0.1 atm (−10.1325 kPa), there is generated a difference between the pressures of the liquid chamber 201*f* and the sub tank 201*b* by the resistance of the filter 201*c*, whereby the pressure in the sub tank 201*b* becomes higher than that in the liquid chamber 201*f* by 0.1 atm (10.1325 kPa). Therefore, by setting the pressure in the suction capo 207*a* at −0.5 atm (−50.6625 kPa), the pressure in the liquid chamber 201*f* becomes −0.45 atm (−45.5963 kPa) while that in the sub tank 201*b* becomes −0.35 atm (−35.4638 kPa).

In order to fill the sub tank 201*b* with ink of 1.7 ml, the volume V1 thereof is so selected that the internal pressure becomes −0.35 atm (−35.4638 kPa) when ink of 1.7 ml is sucked from the sub tank 201*b* having an internal pressure of about 1 atm (101.325 kPa). Thus, V1=1.7/0.35=4.85 ml. Similarly the volume V2 of the liquid chamber 201*f* can be determined as V2=1.2/0.45=2.67 ml.

After the internal pressure of the recording head 201 is reduced under the foregoing conditions, the shut-off valve 210 is opened whereby the ink flows into the recording head 201 in a reduced pressure state. More specifically, at first the ink flows into the sub tank 201*b* whereby the gas inflated to the volume V1 under reduced pressure is restored almost to the atmospheric pressure. The gas volume V1a in the sub tank 201*b* in such state is given by V1a=V1×(1−0.35)=3.15 ml, and the filling is terminated when ink in an amount of V1−V1a=1.7 ml is filled into the sub tank 201*b*. Similarly, in the liquid chamber 201*f*, the ink flows from the sub tank 201*b* whereby the gas inflated to the volume V2 under reduced pressure is restored almost to the atmospheric pressure. The gas volume V2a in the liquid chamber 201*f* in such state is given by V2a=V2×(1−0.45)=1.47 ml, and the filling is terminated when ink in an amount of V2−V2a=1.2 ml is filled into the liquid chamber 201*f*.

Thus, by setting the volumes and reduced pressures of the sub tank 201*b* and the liquid chamber 201*f* in the above-described manner, it is rendered possible to fill the sub tank 201*b* and the liquid chamber 201*f*, separated by the filter 201*c*, with the ink of appropriate amounts in a single filling operation, so that the recording head can be properly operated over a long period even in a situation where gas is accumulated therein.

Also, as explained in the foregoing, gas of the gas holding area is present between the filter 201*c* and the upper surface of the ink in the liquid chamber 201*f*, but the gas volume in such gas holding area can be arbitrarily set by the suction pressure in the suction operation of the recovery unit 207. Thus, the gas in the gas holding area is manageable in the volume thereof.

It is thus rendered possible to significantly improve the reliability against the discharge failure resulting from the bubble generated between the filter and the nozzle. More specifically, against the conventional drawback that the effective area of the filter changes (decreases) by the presence of the unmanageable bubbles under the filter, the present embodiment provides a configuration where the lower surface of the filter 201*c* is in contact, from the beginning, with the gas of the gas holding area in the managed portion (aperture 201*d* in FIG. 2) so that the effective area of the filter 201*c* scarcely changes.

Therefore, the necessary effective area of the filter 201*c* can be controlled in consideration of the above-mentioned fact in the design stage, whereby the reliability can be improved.

Also against the drawback that the bubble clogs the flow path between the filter and the nozzle, the cross sectional area of the liquid chamber 201*f* is selected sufficiently large with respect to the diameter of the bubble that can exist in the liquid chamber 201*f*, so that the ink flow cannot be hindered by the bubble in the liquid chamber 201*f*.

Furthermore, against the drawback that the bubble in the liquid chamber enters the nozzle or clogs the connection between the liquid chamber and the nozzle, the cross sectional area of the liquid chamber 201*f* is selected sufficiently large as explained in the foregoing, so that the bubble generated in the liquid chamber 201*f* rises by the floating force thereof in the ink in the liquid chamber 201*f* and is united with the gas in the gas holding area, thereby being prevented from entering the nozzle 201*g*. Besides, even if the bubble generated in the liquid chamber 201*f* is united with the gas of the gas holding area, the effective area of the filter 201*c* does not change since the gas in the gas holding area is manageable as explained before.

Thus, by constructing the liquid chamber 201*f* separated from the sub tank 201*b* by the filter 201*c* in the above-described manner, it is rendered possible to significantly improve the reliability against the discharge failure resulting from the bubble generation in the liquid chamber 201*f* or from the movement of the generated bubble.

In the following there will be explained other features of the present invention.

In the configuration of the present embodiment, when the shut-off valve 210 is closed, the interior of the recording head 201 is a closed system in which the ink is held by the meniscus pressure at the surface of the nozzle 201*g*. In the following there is considered a situation where the shut-off valve 210 is closed at a low temperature and then the ambient temperature increases. In such case, in the sub tank 201*b* which is opposed to the nozzle 201*g* across the filter 201*c*, there are generated gas inflation and a rise in the vapor pressure, because of the rise in temperature and the decrease in the external pressure. Such gas inflation and the rise in vapor pressure can be absorbed by the pressure adjusting chamber 201*i*.

However, the liquid chamber 201*f*, positioned at the side of the nozzle 201*g* with respect to the filter 201*c*, is not connected with a space such as the pressure adjusting chamber 201*i*, for absorbing the gas inflation or the rise in vapor pressure but has a constant volume. The liquid chamber 201*f*, being directly connected with the nozzle 201*g*, cannot contain even very small particle. Though it is theoretically possible to provide the liquid chamber 201*f* with a space similar to the pressure adjusting chamber 201*i*, the presence of a member susceptible to generate impurity or particle upon deformation, such as rubber, in the liquid chamber 201*f* is impractical in consideration of the manufacturing cost.

Therefore, the gas inflated in the liquid chamber 201*f* pushes out the ink therein to the exterior thereof. In such situation, if the ink in the liquid chamber 201*f* is even partially in contact with the filter 201*c*, for example along the wall of the liquid chamber 201*f* by the surface tension, the ink can pass through the filter 201*c* and can escape into the sub tank 201*b*.

However, in case the entire surface of the filter 201*c* at the side of the liquid chamber 201*f* is exposed to the gas and is not in contact with the ink, the filter 201*c* holds the meniscus by the contact with the ink at the side of the sub tank 201*b*, so that the ink cannot escape to the sub tank 201*b* unless such meniscus is broken.

On the other hand, the meniscus is also held in the nozzle 201*g*, and, if the holding force for such meniscus at the nozzle 201*g* is smaller than that for the meniscus at the filter 201*c*, the ink leaks from the nozzle 201*g*. Moreover, the meniscus in the nozzle 201*g*, if once broken, cannot be easily restored, so that the ink in the liquid chamber 201*f* blows out by an amount corresponding to the gas inflation or increase in vapor pressure.

In the present embodiment, in order to prevent such drawback, the partition portion 201*e* provided at the boundary of the sub tank 201*b* and the liquid chamber 201*f* and supporting the filter 201*c* is so structured that the ink is securely in contact with the face of the filter 201*c* at the side of the liquid chamber 201*f*. In this manner the "force breaking the meniscus formed on the nozzle 201*g*" is made equal to or larger than the "ink moving force to the filter 201*c*" thereby preventing the ink leakage from the nozzle 201*g*. Such structure will be explained in the following with reference to FIGS. 5 and 6.

Figure 5:
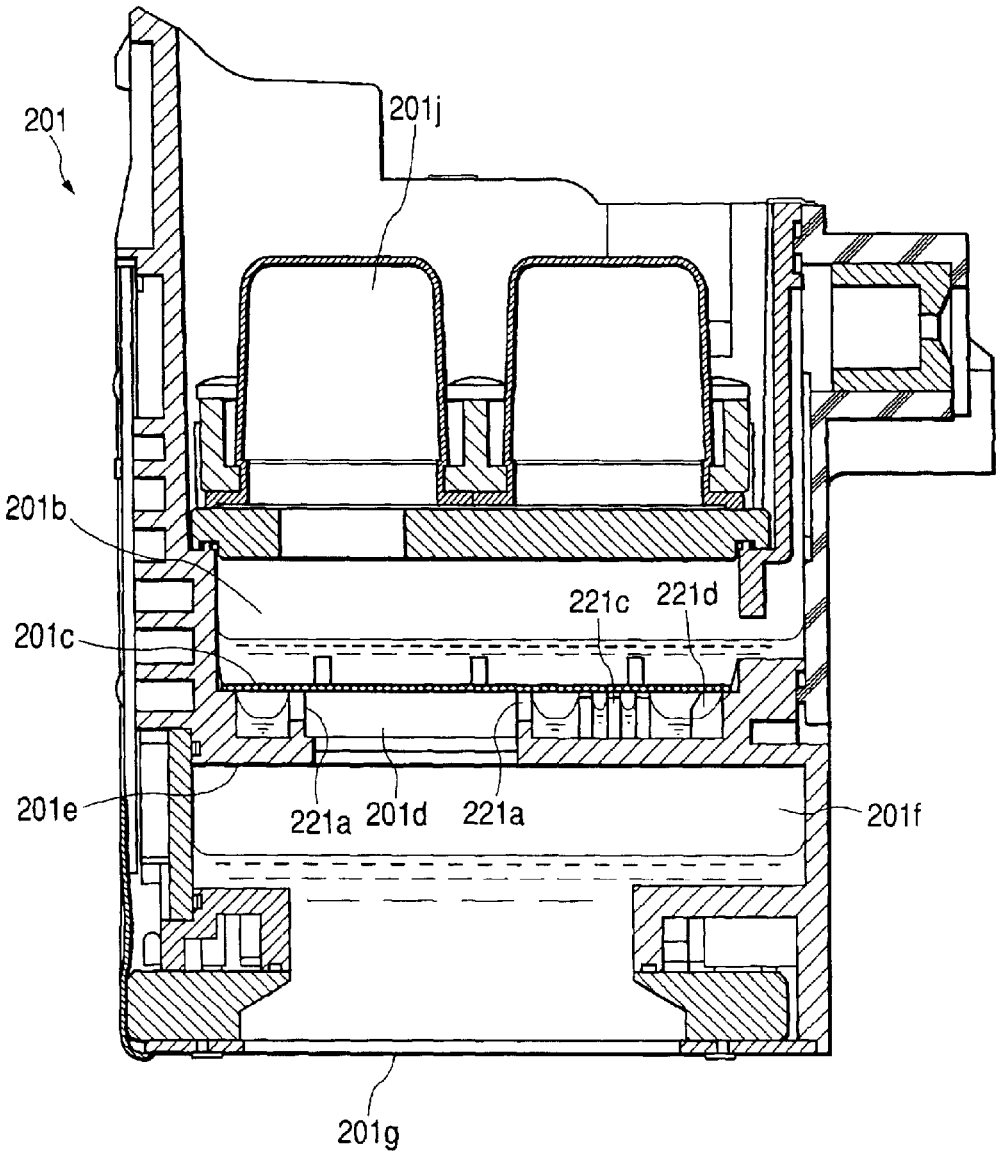
FIG. 5 is a detailed cross-sectional view showing the internal configuration of the recording head shown in FIG. 2.
Figure 6:
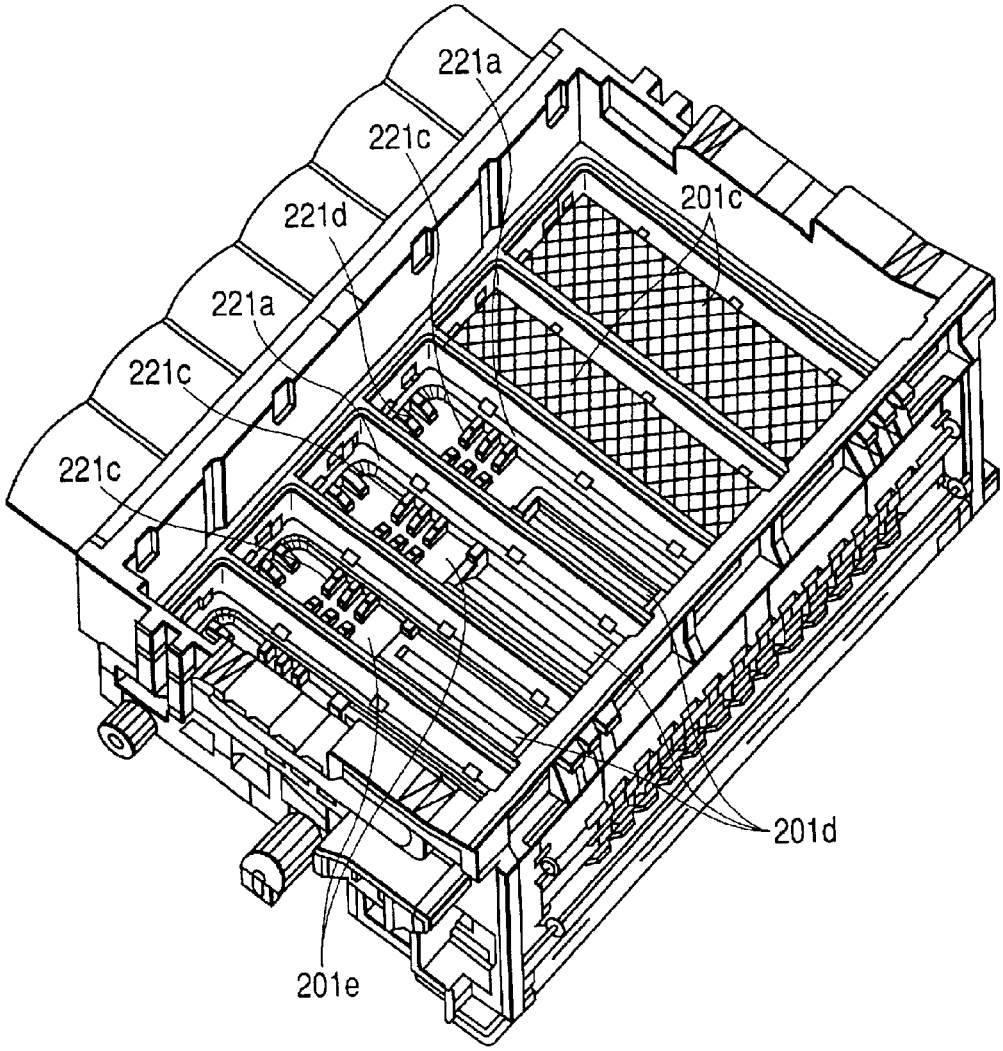
FIG. 6 is a perspective view, seen from above, of the recording head shown in FIG. 2, in a state where an upper wall of a sub tank and a part of a filter are removed.

FIG. 5 is a cross-sectional view showing the detailed internal structure of the recording head shown in FIG. 2, and FIG. 6 is a perspective view, seen from above, of the recording head shown in FIG. 2 in a state where the upper wall of the sub tank and a part of the filter are eliminated. In FIG. 5, the detailed cross-sectional structure of the nozzle 201*g* is omitted.

As shown in FIGS. 5 and 6, in the peripheral portion of the partition portion 201*e*, there is formed a lateral wall 221*a* extending toward the sub tank 201*b*, and the filter 201*c* is in fact placed on the lateral wall 221*a*. In this manner, the ink can also be held in an area surrounded by the lateral wall 221*a*. Stated differently, the partition portion 201*e* constitutes an auxiliary liquid chamber between the sub tank 201*b* and the liquid chamber 201*f*. The height of the lateral wall 221*a* is so selected that the ink held in the partition portion 201*e* can always contact the lower surface of the filter 201*c* by the surface tension (in the drawing, for the purpose of clarity, the ink held in the area surrounded by the lateral wall 221*a* contacts, in a major portion, the lower surface of the filter 201*c* by surface tension.

Inside the area surrounded by the lateral wall 221*a*, there are provided plural ribs 221*c*, 221*d*, of which height is same as that of the lateral wall 221*a* and of which upper ends also contact the lower surface of the filter 201*c*. Thus, the ink rising along the ribs 221*c*, 221*d* by the capillary phenomenon also comes into contact with the lower surface of the filter 201*c*, thereby increasing the amount of the ink in contact with the lower surface thereof.

In the periphery of the aperture 201*d*, the lateral wall 221*a* is made lower in at least a part thereof. Such lower portion of the lateral wall 221*a* is not in contact with the filter 201*c*, and the interior of the partition portion 201*e* and the liquid chamber 201*f* mutually communicate through such portion. In this manner it is rendered possible to secure the gas holding area.

In the above-described configuration, as the ink in the liquid chamber 201*f* is consumed by the ink discharge from the nozzle 201*g*, the negative pressure in the liquid chamber 201*f* gradually increases. As the liquid chamber 201*f* communicates with the interior of the partition portion 201*c*, the negative pressure therein also increases like the negative pressure in the liquid chamber 201*f*.

Figure 7:
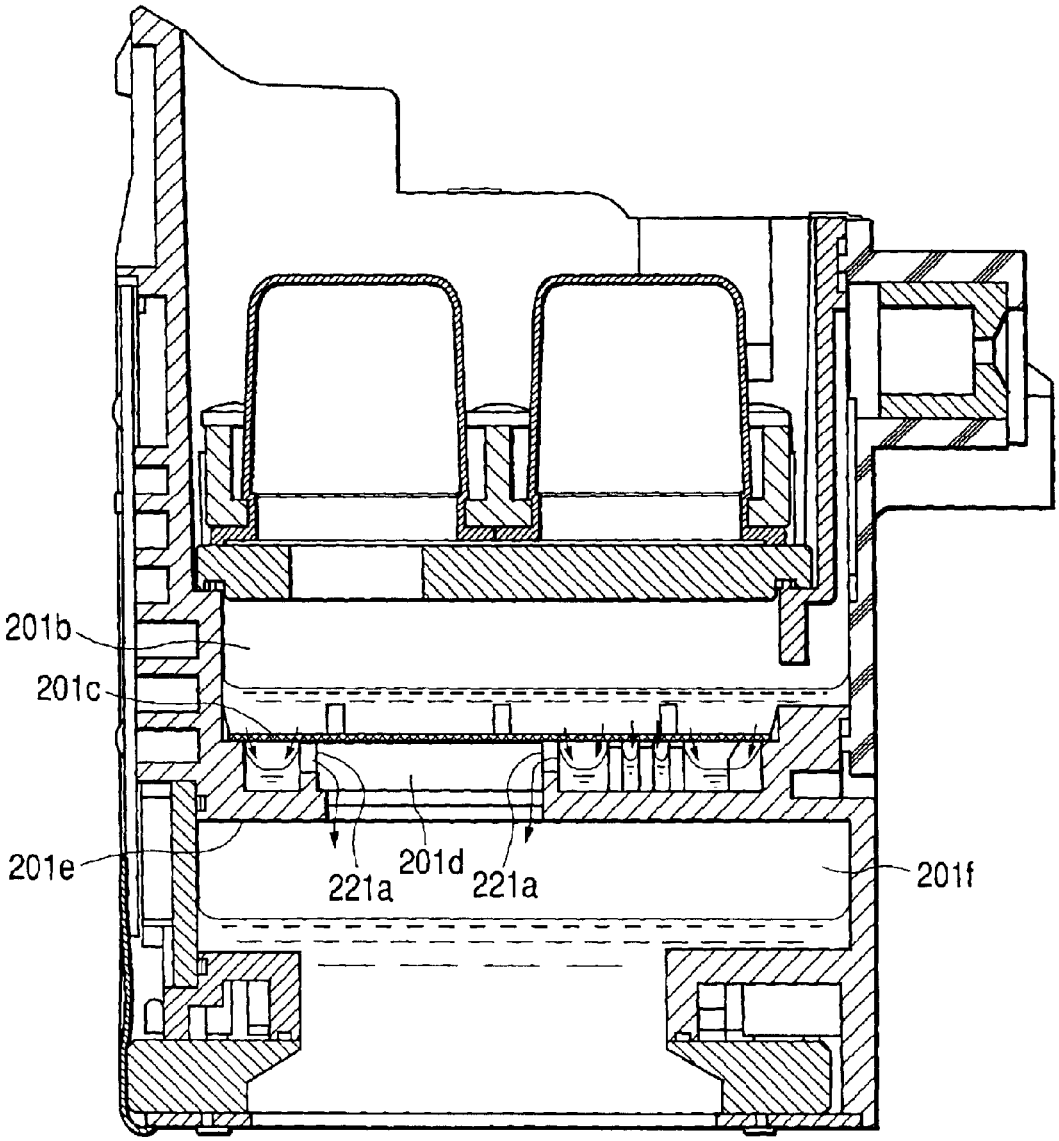
FIG. 7 is a cross-sectional view similar to FIG. 5, showing the ink flow from the sub tank to the liquid chamber.

The negative pressure increase in the liquid chamber 201*f* and the interior of the partition portion 201*e* causes the ink to flow into the liquid chamber 201*f* from the sub tank 201*b* through the filter 201*c*. In this operation, since the ink held by 221*a*, 221*c*, 221*d* etc. in the partition portion 201*e* is in contact with the lower surface of the filter 201*c* by the surface tension, the ink flow is facilitated in such portion. Consequently, as indicated by an arrow in FIG. 7, the ink in the sub tank 201*b* flows from a portion, in contact with the ink, of the lower surface of the filter 201*c* into the partition portion 201*e* through the lateral wall 221*a* and the ribs 221*c*, 221*d*, and the ink thus flowing in overflows from the lateral wall 221*a* around the aperture 201*d* to enter the liquid chamber 201*f*.

Figure 8:
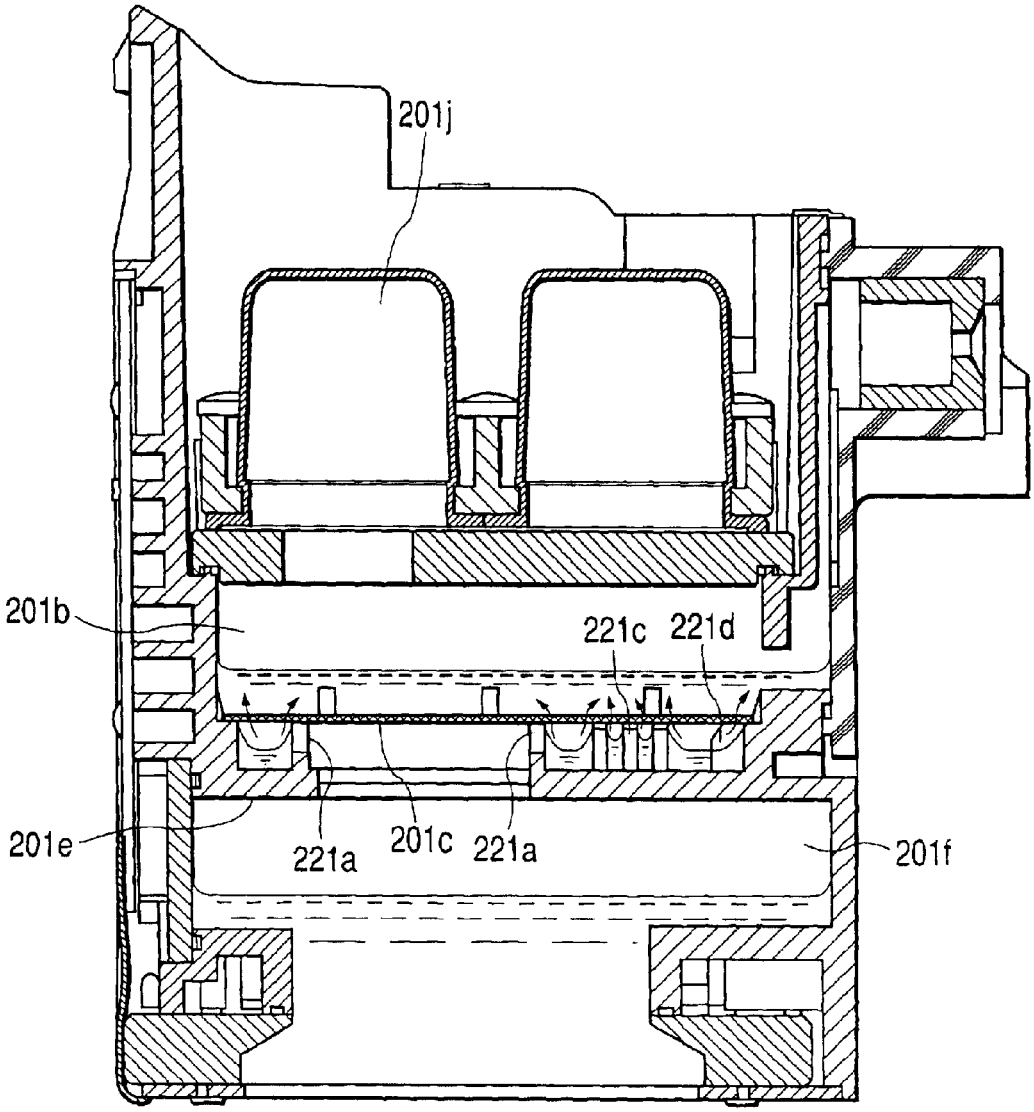
FIG. 8 is a cross-sectional view similar to FIG. 5, showing the flow of ink and gas in a closed state.

Now there will be explained, with reference to FIG. 8, the ink flow in case of gas inflation or an increase in the vapor pressure in the recording head 201, induced for example by an increase in the ambient temperature or a decrease in the external pressure while the shut-off valve 210 (cf. FIG. 2) is closed.

In case of gas inflation or an increase in the vapor pressure in the liquid chamber 201*f*, the gas of a volume corresponding to such inflation or pressure increase has to either escape to the sub tank 201*b* through the filter 201*c* or push out the ink (including the ink in the partition portion 201*e*) in the liquid chamber 201*f* to the exterior, but, in practice, the latter situation takes place because it is difficult for the gas in the liquid chamber 201*f* to pass through the filter 201*c* in contact with the ink in the sub tank 201*b* as already explained before. However, in the partition portion 201*e*, the ink held by the components 221*a*, 221*c*, 221*d* etc. is in contact with the filter 201*c* by the surface tension and the ink can easily pass through the filter 201*c* in such contact portion thereof. Thus, in case of gas inflation of an increase in the vapor pressure in the liquid chamber 201*f*, the ink in the partition portion 201*e* flows into the sub tank 201*b* through the lateral wall 221*a* or the ribs 221*c*, 221*d* and the filter 201*c*.

On the other hand, the sub tank 201*b*, being provided with the pressure adjusting chamber 201*i* as explained in the foregoing, can absorb the volume increase resulting from the ink flow through the filter 201*c* as a result of gas inflation or an increase in the vapor pressure in the liquid chamber 201*f*.

In such situation, in order that the ink in the partition portion 201*e* is not depleted, the ink holding volume Vf in the partition portion 201*e* and the maximum gas volume increase $\Delta Vmax$ in the liquid chamber 201*f* have to satisfy a relation $Vf > \Delta Vmax$. The value $\Delta Vmax$ can be given by (the gas volume in liquid chamber 201*f*)×(estimated maximum temperature change ratio) in case the gas inflation or the increase in the vapor pressure in the recording head 201 is induced by a temperature increase.

Since the above-described configuration of the partition portion 201*e* allows to maintain the surface of the filter 201*c* at the side of the liquid chamber 201*f* always in contact with the ink, even in case of gas inflation or an increase in the vapor pressure in the liquid chamber 201*f*, the ink of an amount corresponding to the gas volume increase can be moved smoothly to the sub tank 201*b* through the filter 201*c*, thereby preventing the ink blow-out phenomenon from the nozzle 201*g*. Besides, as the contact of the ink with the filter 201*c* in the partition portion 201*e* is achieved by the capillary phenomenon by the lateral wall 221*a* and the ribs 221*c*, 221*d*, there cannot be generated a bubble in such contact portion. Furthermore, the effective area of the filter 201*c* remains substantially constant, because the contact between the ink and the lower surface of the filter 201*c* is made in a predetermined area.

Also in the present embodiment, the structure for contacting ink with the surface of the filter 201*c* at the side of the liquid chamber 201*f* is constructed utilizing the partition portion 201*e* in which the filter 201*c* is provided, and can therefore be realized easily and inexpensively without requiring special members or special manufacturing steps. The ribs 221*c*, 221*d* are not particularly limited in number or position, but, it is preferred to increase the number of the ribs and to reduce the gaps thereof in order to hold a larger amount of ink in the partition portion 201*e* and to contact a larger amount of ink with the filter 201*c*.

The position of the aperture 201*d* can be arbitrarily selected in the partition portion 201*e*, but, in order that the entire periphery of the aperture 201*d* can be utilized as a lateral wall for generating capillary phenomenon, it is preferable to form the aperture 201*d* in a position separated from the internal wall of the sub tank 201*b* or the liquid chamber 201*f* thereby forming the partition portion 201*e* as a kind of corridor structure having the aperture 201*d* at the center. Also in case a small ink holding amount is enough in the partition portion 201*e*, it is also possible to form the partition portion 201*e* as a flat plate shape for supporting the filter 201*c* in a planar manner and to generate the capillary phenomenon directly in such supporting area.

[Second Embodiment]

Figure 9:
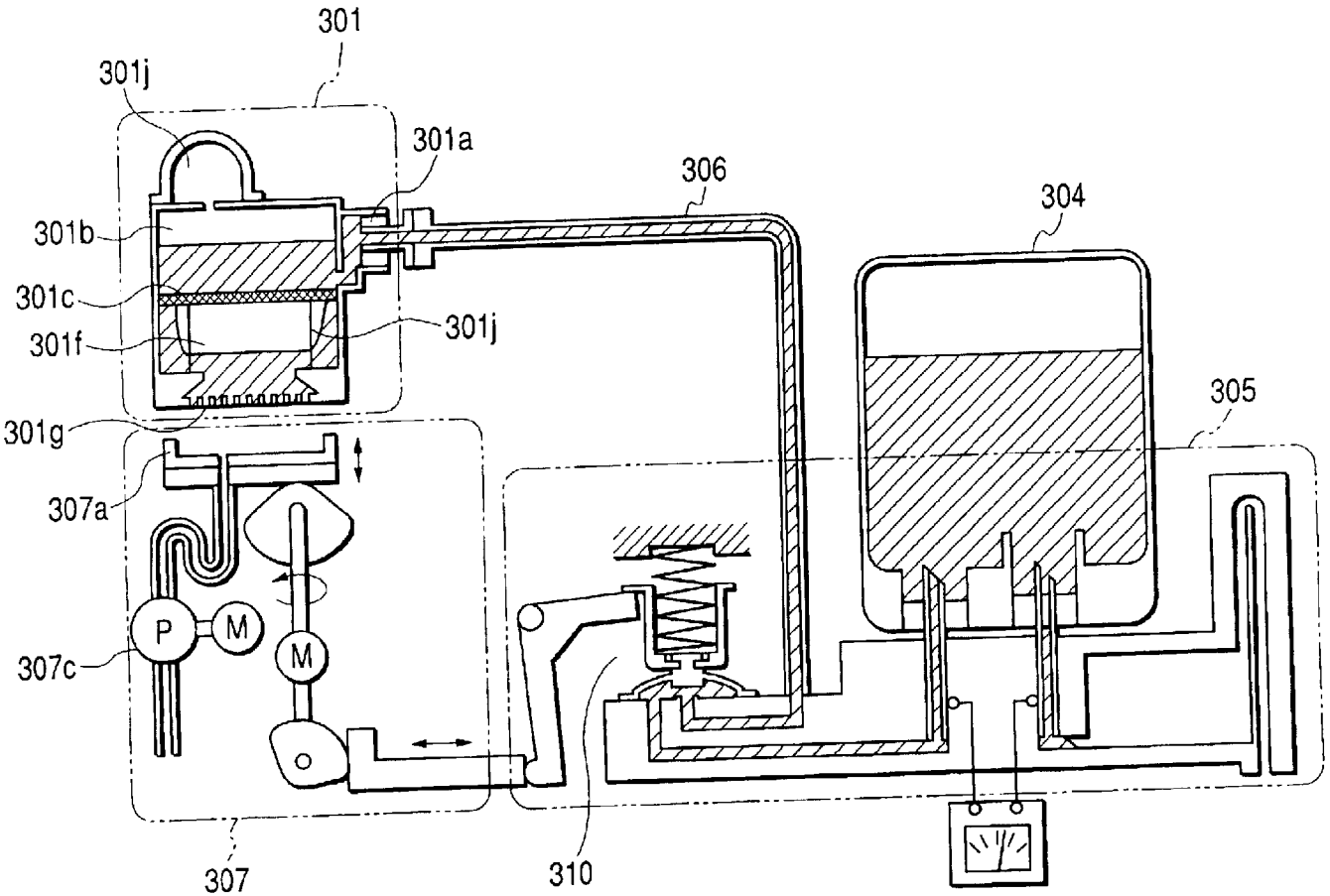
FIG. 9 is a view showing the ink supply path of an ink jet recording apparatus constituting a second embodiment of the present invention.
Figure 10:
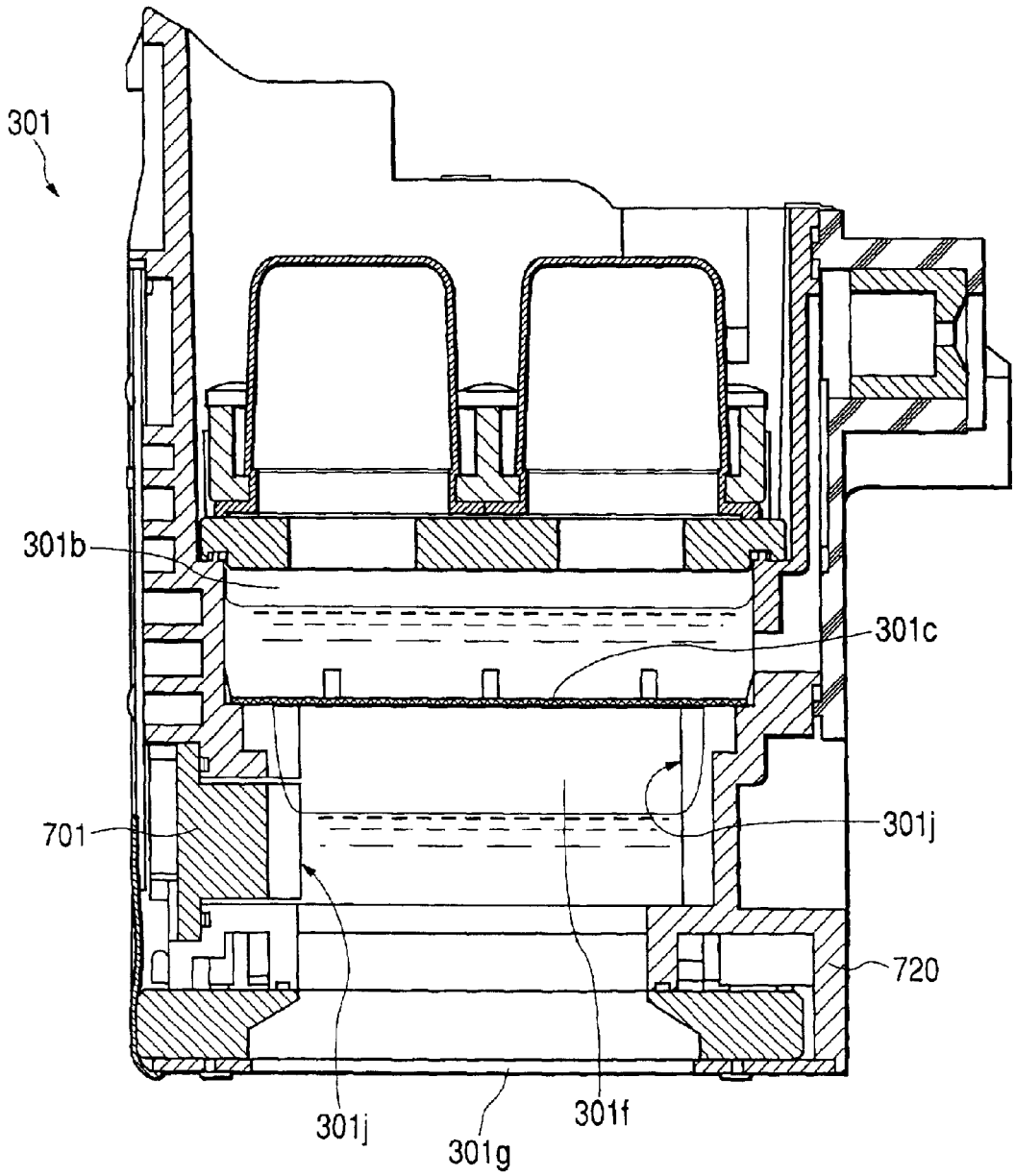
FIG. 10 is a detailed cross-sectional view showing the internal configuration of the recording head shown in FIG. 9.
Figure 11:
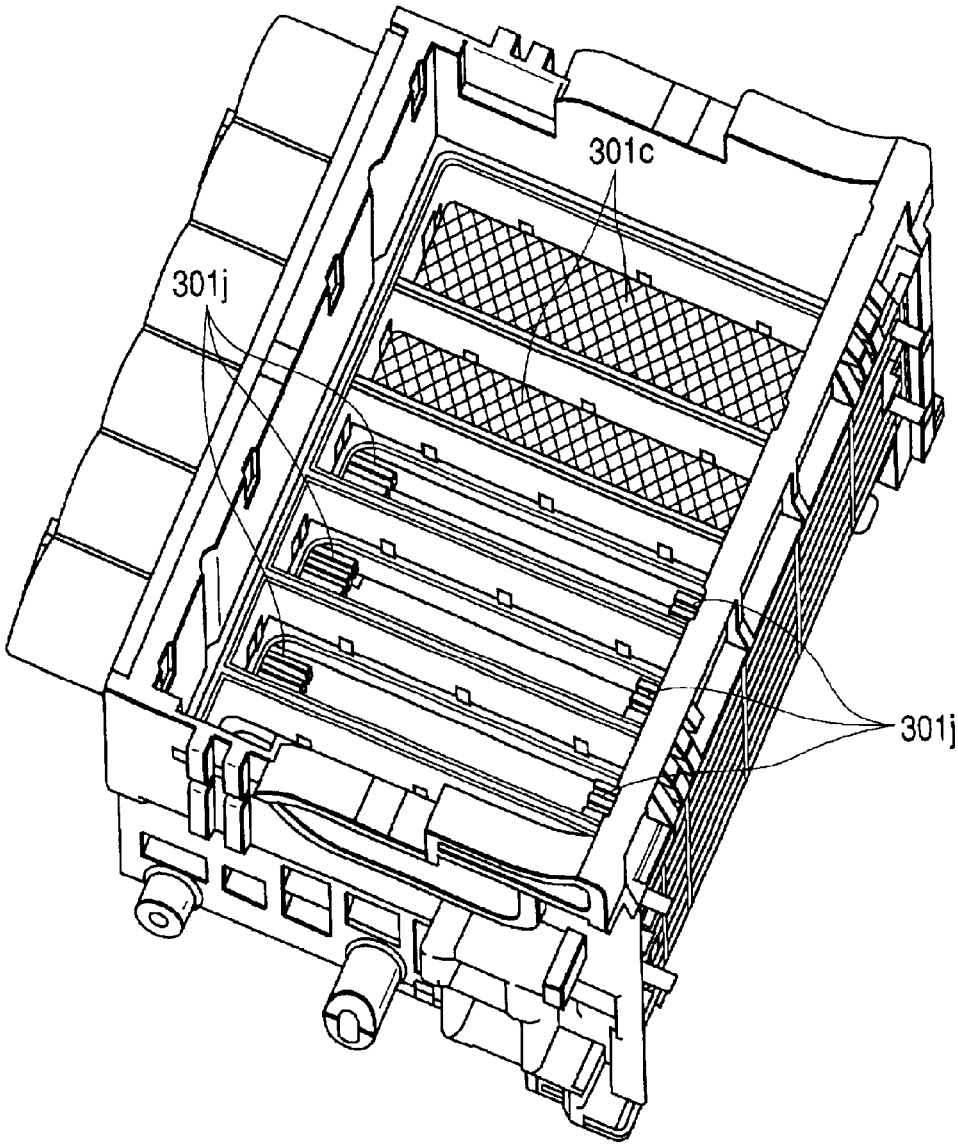
FIG. 11 is a perspective view, seen from above, of the recording head shown in FIG. 9, in a state where an upper wall of a sub tank and a part of a filter are removed.

FIG. 9 is a view showing the ink supply path in an ink jet recording apparatus constituting a second embodiment of the present invention, while FIG. 10 is a cross-sectional view showing the detailed internal structure of the recording head shown in FIG. 9, and FIG. 11 is a perspective view, seen from above, of the recording head shown in FIG. 9 in a state where the upper wall of the sub tank and a part of the filter are eliminated. In FIG. 10, the detailed cross-sectional structure of the nozzle 301*g* is omitted.

The ink jet recording apparatus of the present embodiment is also an ink jet recording apparatus of serial scan type as in the first embodiment, and has an entire configuration similar to that shown in FIG. 1. Also the present embodiment is similar to the first embodiment in forming a color image by discharging inks of plural colors, but FIG. 9 shows, as in FIG. 2, the ink supply path for a color only.

In the present embodiment, the configuration of the recording head 301 is different from that in the first embodiment. However, it is similar to the first embodiment in other aspects, such as that the ink supply to the recording head 301 is executed from a main tank 304 through an ink supply unit 305 and an ink supply tube 306, and that a recovery unit 307 having a suction cap 307*a* and a suction pump 307*b* is provided for forcedly sucking ink from a nozzle 301*g* of the recording head 301 at the ink filling into the recording head 301 or at the elimination of viscosified ink etc. from the recording head 301. Also the configuration of the main tank 304, ink supply unit 305, ink supply tube 306 and recovery unit 307 is similar to that in the first embodiment. Therefore, in the following, the description will omit these same or similar aspects and will be concentrated on the recording head 301.

The recording head 301 is provided with a sub tank 301*b* having a connector inserting port 301*a* in which the liquid connector of the ink supply tube 306 is connected and a pressure adjusting chamber 301*i*, a liquid chamber 301*f* provided gravitationally below the sub tank 301*b* and serving to directly supplying the nozzle 301*g* with ink, and a filter 301*c* provided between the sub tank 301*b* and the liquid chamber 301*f*. In the liquid chamber 301*f*, a gas holding area is formed between the ink in the liquid chamber 301*f* and the filter 301*c*, by the liquid chamber 301*f*, filter 301*c* and a liquid chamber groove structure 301*j*, for securing gas so as to intercept the bubble movement from the nozzle 301*g* to the filter 301*c*, and also a predetermined amount of ink is stored.

On the internal lateral wall of the liquid chamber 301*f*, there is provided the liquid chamber groove structure 301*j* formed along the ink supply direction from the sub tank 301*b* to the liquid chamber 301*f*, namely along the vertical direction and extending from the bottom of the liquid chamber 301*f* to a position almost touching the filter 301*c*. The liquid chamber 301*f* has a substantially rectangular transversal cross section, and the aforementioned groove structure 301*i* is provided on both longitudinal ends in the cross section of the liquid chamber 301*f*. The groove structure 301*j*, to be explained later in more details, has such a dimension and a shape that the ink in the liquid chamber 301*f* can be held by surface tension in the groove structure 301*j* and can thus be contacted with the lower surface of the filter 301*c*. Thus the ink in the liquid chamber 301*f* is connected with the ink in the sub tank 301*b* through the groove structure 301*j* and the filter 301*c*. Consequently, the minimum necessary ink amount to be accumulated in the liquid chamber 301*f* is an amount required for filling the nozzle 301*g* with ink, also for securing the gas of desired amount by the gas holding area formed by the liquid chamber 301*f*, filter 301*c* and groove structure 301*j*, and for connecting with the ink in the sub tank 301*b* through the groove structure 301*j* and the filter 301*c*. Also since the groove structure 301*j* holds the ink by the surface tension, the gas in the gas holding area cannot enter the groove structure 301*j* by breaking the surface tension of the ink.

Based on such configuration of providing the liquid chamber 301*f* with the groove structure 301*j*, contacting the upper surface of the filter 301*c* with the ink in the sub tank 301*b*, forming the gas holding area on the lower surface to hold the gas of the desired amount, and in an adjacent position contacting the ink with the filter 301*c* utilizing the groove structure 301*j* and the surface tension, the ink achieves connection through the filter 301*c* in a portion thereof in contact with the ink on the upper and lower surfaces. The area of such ink connection in the filter 301*c* constitutes the effective area thereof. In the present embodiment, the groove structure 301*j* is provided in plural units on each of the longitudinal ends of the liquid chamber 301*f* in the lateral cross section thereof, thereby increasing the effective area of the filter 301*c* and reducing the pressure loss therein.

In the above-described configuration, as the ink in the liquid chamber 301*f* is consumed by the ink discharged from the nozzle 301*g*, the negative pressure in the liquid chamber 301*f* gradually increases. The ink in the liquid chamber 301*f* is connected with the ink in the sub tank 301*b* through the groove structure 301*j* and the filter 301*c*, and the ink can easily move in such connecting portion. Therefore, when the negative pressure in the liquid chamber 301*f* increases, the ink in the sub tank 301*b* flows into the liquid chamber 301*f* through the portion of the filter 301*c* where the lower surface is in contact with the ink, and through the groove structure 301*j*.

In case of a long standing in this state, gas is accumulated in the recording head 301 to induce various drawbacks as in the first embodiment, but, against such gas accumulation, the present embodiment can maintain the ink discharging performance in stable manner over a long period, as in the first embodiment, by filling the ink from the main tank 304 into the sub tank 302*b* and the liquid chamber 301*f*. The ink filling from the main tank 304 into the sub tank 301*b* and the liquid chamber 301*f* and the setting of the volumes thereof are similar to those in the first embodiment, but the ink filling condition and the specific numbers of the respective volumes are different from those in the first embodiment since, in the present embodiment, the ink in the sub tank 301*b* is in contact with that in the liquid chamber 301*f* through the groove structure 301*j* and the filter 301*c*.

In the following there will be explained specific examples of the aforementioned ink filling operation into the sub tank 301*b* and the liquid chamber 301*f* and of the volume setting.

It is assumed, as in the first embodiment, that the ink filling is executed every month, and the gas accumulating amount per month is 1 ml in the sub tank 301*b* and 0.5 ml in the liquid chamber 301*f*. It is also assumed that the ink amount required in the sub tank 301*b* not to expose the filter 301*c* to gas is 0.5 ml while the ink amount required in the liquid chamber 301*f* not to expose the nozzle 301*g* to gas is 0.5 ml, and the fluctuation in the ink filling amount is 0.2 ml both in the sub tank 301*b* and the liquid chamber 301*f*. Thus the ink amount to be filled in a single filling operation is the sum of these amounts, and is 1.7 ml in the sub tank 301*b* and 1.2 ml in the liquid chamber 301*f*. The suction pump 307*c* is capable of pressure reduction to 0.8 atm (81.060 kPa).

The reduced pressure in the recording head 301 under these conditions is selected, within the power limit of the suction pump 307*c*, by the suction amount of the suction pump 307*c* so as to realize a pressure of −0.6 atm (−60.795 kPa) in the suction cap 307*a*.

As the pressure required for gas permeation against the meniscus in the nozzle 301*g* is experimentally −0.05 atm (−5.06625 kPa), the pressure in the liquid chamber 301*f* becomes higher than that in the suction cap 307*a* by 0.05 atm (5.06625 kPa) as in the first embodiment. Similarly, as the pressure required for gas permeation against the meniscus in the filter 301*c* is experimentally −0.1 atm (−10.1325 kPa), the pressure in the sub tank 301*b* becomes higher than that in the liquid chamber 301*f* by 0.1 atm (10.1325 kPa). Therefore, by setting the pressure in the suction cap 307*a* at −0.6 atm (−60.795 kPa), the pressure in the liquid chamber 301*f* becomes −0.55 atm (−55.72875 kPa) while that in the sub tank 301*b* becomes −0.45 atm (−45.59625 kPa).

In order to fill the sub tank 301*b* with ink of 1.7 ml, the volume V1 thereof is so selected that the internal pressure becomes −0.45 atm (−45.59625 kPa) when ink of 1.7 ml is sucked from the sub tank 301*b* having an internal pressure of about 1 atm (101.325 kPa). Thus, V1=1.7/0.45=3.78 ml. Similarly the volume V2 of the liquid chamber 301*f* can be determined as V2=1.2/0.55=2.18 ml.

After the internal pressure of the recording head 301 is reduced under the foregoing conditions, the shut-off valve 310 of the ink supply unit 305 is opened whereby the ink flows into the recording head 301 in a reduced pressure state. More specifically, at first the ink flows into the sub tank 301*b* whereby the gas inflated to the volume V1 under reduced pressure is restored almost to the atmospheric pressure. The gas volume V1a in the sub tank 301*b* in such state is given by V1a=V1×(1−0.45)=2.08 ml, and the filling is terminated when ink in an amount of V1−V1a=1.7 ml is filled into the sub tank 301*b*. Similarly, in the liquid chamber 301*f*, the ink flows from the sub tank 301*b* whereby the gas inflated to the volume V2 under reduced pressure is restored almost to the atmospheric pressure. The gas volume V2a in the liquid chamber 301*f* in such state is given by V2a=V2×(1−0.55)=0.98 ml, and the filling is terminated when ink in an amount of V2−V2a=1.2 ml is filled into the liquid chamber 301*f*.

Thus, by setting the volumes and reduced pressures of the sub tank 301*b* and the liquid chamber 301*f* in the above-described manner, it is rendered possible to fill the sub tank 301*b* and the liquid chamber 301*f*, separated by the filter 301*c*, with the ink of appropriate amounts in a single filling operation, so that the recording head can be properly operated over a long period even in a situation where gas is accumulated therein.

Also, in the present embodiment, the effective area of the filter 301*c* remains substantially constant, because, on the lower surface of the filter 301*c*, there are substantially fixed the area holding the ink by surface tension in cooperation with the groove structure 301*j* and the area in contact with the gas of the gas holding area.

Therefore, the necessary effective area of the filter 301*c* can be controlled in consideration of the above-mentioned fact in the design stage, whereby, as in the first embodiment, there can be significantly improved the reliability against the discharge failure resulting from the bubble generation in the liquid chamber 301*f* or the movement of generated bubble.

The groove structure 301*j* in the present embodiment functions similarly to the partition portion 201*e* (cf. FIG. 5) in the first embodiment. More specifically, in case the ambient temperature rises while the shut-off valve 310 of the ink supply unit 305 is closed to maintain the interior of the recording head 301 in a closed system in which the ink is held by the meniscus pressure at the surface of the nozzle 301*g*, the groove structure 301*j* serves to regulate the pressure increase resulting from the gas inflation or the increase in the vapor pressure in the liquid chamber 301*f*.

In case of gas inflation or an increase in the vapor pressure in the liquid chamber 301*f* while the recording head constitutes a closed system, the ink in the liquid chamber 301*f* is pushed out to the exterior by the gas volume corresponding to such inflation or increase in the vapor pressure. As the ink held by the groove structure 301*j* is in contact with the filter 301*c* and the ink can easily pass through the filter 301*c* in such contact portion, there is realized a condition that the "force required for breaking the meniscus formed in the nozzle 301*g*" is equal to or larger than the "force required for ink movement in the filter 301*c*", whereby the ink in the liquid chamber 301*f* flows into the sub tank 301*b* through the groove structure 301*j* and the filter 301*c*. On the other hand, in the sub tank 301*b*, as in the first embodiment, the gas inflation or the increase in vapor pressure in the sub tank 301*b* resulting from the ambient temperature and the volume increase resulting from the ink flow from the liquid chamber 301*f* are absorbed by the pressure adjusting chamber 301*i*.

As explained in the foregoing, the groove structure 301*j* of the present embodiment allows to always maintain the ink in contact also with the surface of the filter 301*c* at the side of the liquid chamber 301*f*. Therefore, even in case of gas inflation or an increase in the vapor pressure in the liquid chamber 301*f*, the ink of an amount corresponding to the gas volume increase can be moved smoothly to the sub tank 301*b* through the filter 301*c*, thereby preventing the ink blow-out phenomenon from the nozzle 301*g*. Also the groove structure 301*j* is not particularly limited in number or position, but it is preferred to increase the number of the groove structure and to reduce the gap thereof in order to hold a larger amount of ink and to contact a larger amount of ink with the filter 301*c*.

Figure 12:
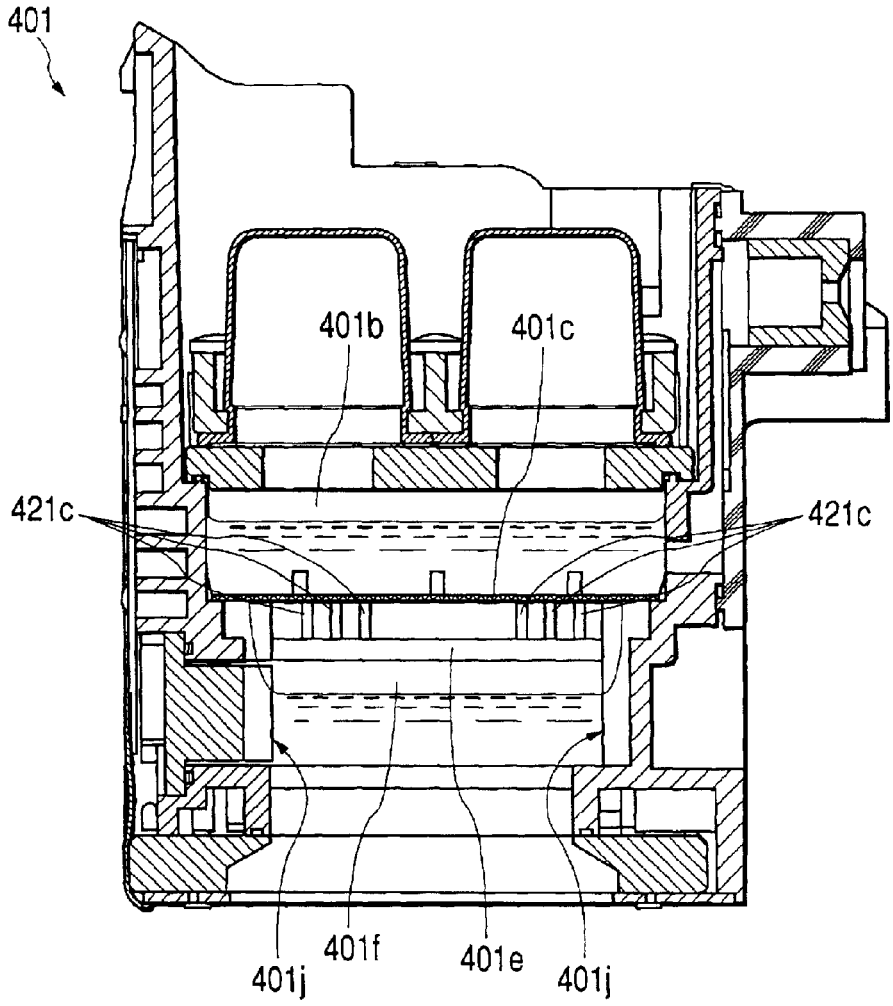
FIG. 12 is a view showing a variation of the recording head shown in FIG. 9.

The present embodiment shows a configuration where the liquid chamber 301*f* is provided with the groove structure 301*j* for contacting the ink with a part of the lower surface of the filter 301*c*, but such groove structure 301*j* may also be combined with the structure shown in the first embodiment. FIG. 12 is a cross-sectional view showing the internal structure of the recording head in such case.

In a recording head 401 shown in FIG. 12, a partition portion 401*e* supporting a filter 401*c* is constructed in a similar manner as in the first embodiment. More specifically, the partition portion 401*e* is provided on the upper surface thereof with plural ribs 421*c*, and the filter 401*c* is supported thereon, whereby a desired gas holding area is formed. Also a groove structure 401*j* is formed on the internal lateral wall of a liquid chamber 401*f*, as shown in FIG. 10.

Presence of such ribs 421*c* on the upper face of the partition portion 401*e* achieves ink holding between the ribs 421*c* thereby contacting ink with the lower surface of the filter 401*c* as explained in the first embodiment, in addition to that by the groove structure 401*j*. As a result, the contact area with ink increases on the lower surface of the filter 401*c*, thereby enabling more smoothly the ink movement from the sub tank 401*b* to the liquid chamber 401*f* and that from the liquid chamber 401*f* to the sub tank 401*b* in case of gas inflation or an increase in the vapor pressure in the liquid chamber 401*f*. In the manner that the structure provided in the liquid chamber 401*f* for contacting the ink with a part of the lower surface of the filter 401*c* is called the liquid chamber groove structure 401*j*, the plural ribs 421*c* on the partition portion 401*e* can be called the partition portion groove structure.

[Other Embodiments]

In the following there will be explained the detailed structures applicable to the foregoing embodiments.

(Positional Relationship of Filter and Groove Structure)

Figure 13:
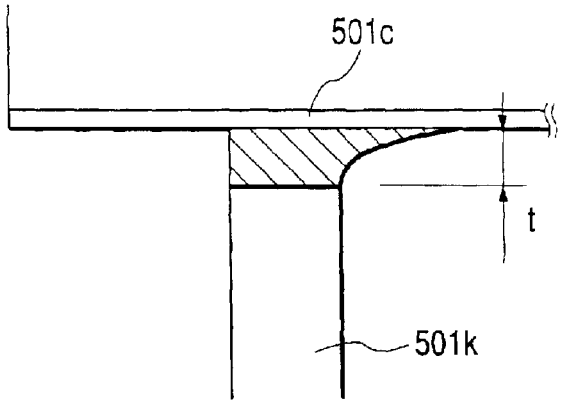
FIG. 13 is a lateral view showing the relationship between a groove structure and the filter in the upper end portion of a groove structure applicable in the present invention.

FIG. 13 is a lateral view showing the positional relationship between the groove structure and the filter in the upper end portion of the groove structure. In FIG. 13, the filter 501*c* is supported at the periphery thereof, and a gap t is present between the filter 501*c* and the groove structure 501*h*. The groove structure 501*h* herein collectively means a structure capable of holding the ink by the surface tension thereof and contacting it with the lower surface of the filter 501*c*, and more specifically indicates the plural ribs on the partition portion in the first embodiment, or the groove structure in the liquid chamber or the plural ribs on the partition portion in the second embodiment. The term "groove structure" in the following description has the same meaning.

As indicated by a hatched area in FIG. 13, the ink is held by the surface tension between the filter 501*c* and the groove structure 501*h*. An increase in the gap t between the filter 501*c* and the groove structure 501*h* reduces the surface tension, whereby the ink holding state by the surface tension between the filter 501*c* and the groove structure 501*h* can no longer be maintained and becomes broken for example by the weight of the ink itself or by vibration.

In the following there will be shown the result of investigation by the present inventors on the relationship of the gap t and the ink holding state between the filter 501*c* and the groove structure 501*h*.

In this investigation, the recording head of the foregoing embodiments was provided with a groove structure 501*h* of a depth (lateral length thereof in FIG. 13) of 2 mm and an aperture width (groove width) of 0.5 mm, and ink of a surface tension of 35 mN/m was filled according to the foregoing embodiments. There was experimented the presence of ink leakage from the nozzle when the temperature of the recording head was changed from 5° C. to 60° C. The obtained results are shown in Table 1.

TABLE 1

| Gap t (mm) | Head Still State | Head Driven State |
|---|---|---|
| 0 | No ink leakage | No ink leakage |
| 0.5 | No ink leakage | No ink leakage |
| 0.8 | No ink leakage | No ink leakage |
| 1.0 | Ink leakage from some nozzles | No ink leakage |
| 1.2 | Ink leakage from all nozzles | Ink leakage from some nozzles |

In Table 1, the temperature rise in the "head still state" means the ambient temperature change around the recording head from 5° C. to 60° C. On the other hand, in the temperature rise in the "head driven state", the ink jet recording apparatus mounted with the recording head was operated at 5° C. and the recording head was brought to 60° C. by temperature increase under ink discharge.

In the experiment, in the "head still state", the ink leakage started from t=1.0 mm. On the other hand, in the "head driven state", the ink leakage did not occur at t=1.0 mm, presumably because, in such state, the ink in the liquid chamber is consumed to generate an ink flowing force from the sub tank to the liquid chamber through the filter 501*c*, whereby the ink holding state between the filter 501*c* and the groove structure 501*h* could be maintained.

Based on these results, the ink leakage does not occur, for the gap t between the filter 501*c* and the groove structure 501*h*, in a condition $0 \leqq t \leqq 1.0$ mm, preferably $0 \leqq t \leqq 0.8$ mm.

Figure 14A:
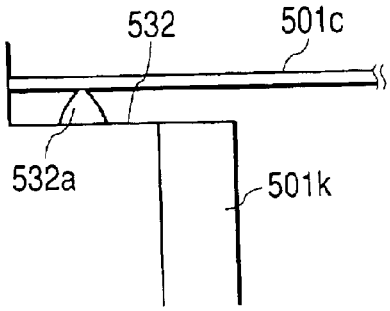
FIGS. 14A, 14B and 14C are lateral views showing the joint structure of a filter applicable to the present invention.
Figure 14B:
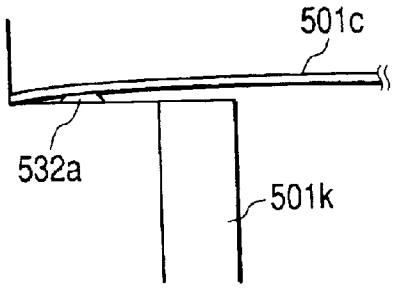
Figure 14C:
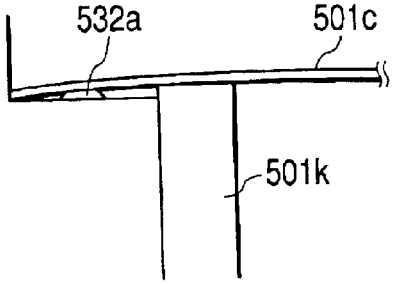

The filter can be jointed for example by fusion. FIG. 14A is a lateral view of the vicinity of the groove structure 501*k* prior to the jointing of the filter 501*c* by fusion. As shown in FIG. 14A, a support face 532 for the filter 501*c* is provided with fusion ribs 532*a*. The fusion jointing of the filter 501*c* can be achieved by placing the filter 501*c* on the fusion ribs 532 and pressing the 501*c* to the support face 532 with an unrepresented fusing hone thereby fusing and crushing the ribs 532*a*. FIG. 14B shows a state after fusion jointing of the filter 501*c*. In such fusion jointed state of the filter 501*c*, thereby may be generated a gap between the filter 501*c* and the groove structure 501*k* because of the remainder of the fusion ribs 532*a* or the deformation in the filter 501*c*, though depending on the fusing condition, shape of fusion ribs 532*a* and shape of the filter 501*c*. Particularly in case the distance between the filter 501*c* and the groove structure 501*k* is large, such gap changes by the surface irregularity of the filter 501*c* after the fusion jointing. In order to minimize such gap (within the aforementioned range of t), it is possible, as shown in FIG. 14C, to cause the groove structure 501*k* to protrude from the support face 532*a* by about 0.1 mm toward the filter 501*c*, thereby maintaining the filter 501*c* and the groove structure 501*k* always in contact.

The above-mentioned method for controlling the gap between the filter 501*c* and the groove structure 501*k* is applicable not only in case of the fusion jointing of the filter 501*c* but also in other jointing methods. However, in case of jointing with adhesive, attention is necessary in using adhesive of a low viscosity since such adhesive may flow into the groove structure 501*k* to deteriorate the function thereof.

(Shape of Groove Structure)

The ink lifting force F by the surface tension in the groove structure is given by:

$$F = L \times T \times \cos\theta$$

wherein T is the surface tension of ink, θ is the contact angle of ink in the groove structure, and L is the circumferential length of the ink contact area in the groove structure.

The weight W of the lifted ink is given by:

$$W = Si \times hi \times \rho \times g$$

wherein hi is the height of lifted ink, ρ is density of ink, g is the acceleration of gravity and Si is the cross section of the ink contact area in the groove structure.

Since F=W, there can be obtained a relationship $L \times T \times \cos\theta = Si \times hi \times \rho \times g$ which can be deformed as $$hi = L/Si \times (T \cos\theta/\rho g) \quad (1)$$

Consequently, for a height d of the groove structure, the ink held by the groove structure can reach the upper end thereof by the surface tension by so selecting the groove structure as to satisfy a condition d≦hi, whereby the ink can be contacted with the lower surface of the filter.

Figure 15:
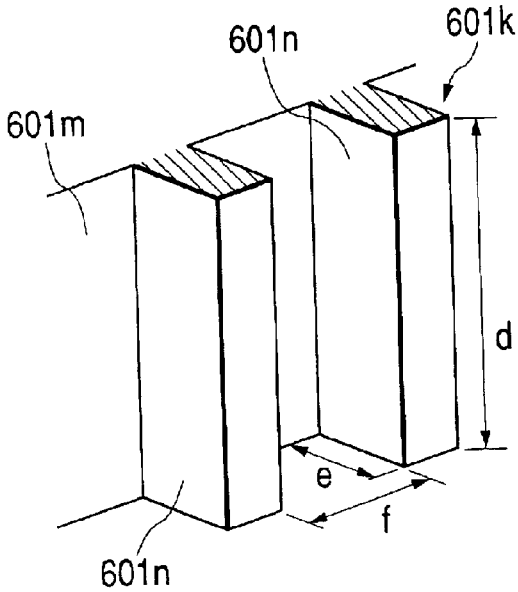
FIG. 15 is a perspective view showing an example of the groove structure applicable to the present invention.

Now let us consider a recessed groove structure 601*k* as shown in FIG. 15, having a height d, a depth e and an aperture width f and composed of two rectangular pillars 601*n* positioned in contact with a wall portion 601*m*. Applying the equation (1) to such structure, there can be obtained:

$$hi = (2e + f)/ef \times (T\cos\theta/pg) \quad (1)$$

$$= (1/e + 2/f) \times (T\cos\theta/pg)$$

Figure 16:
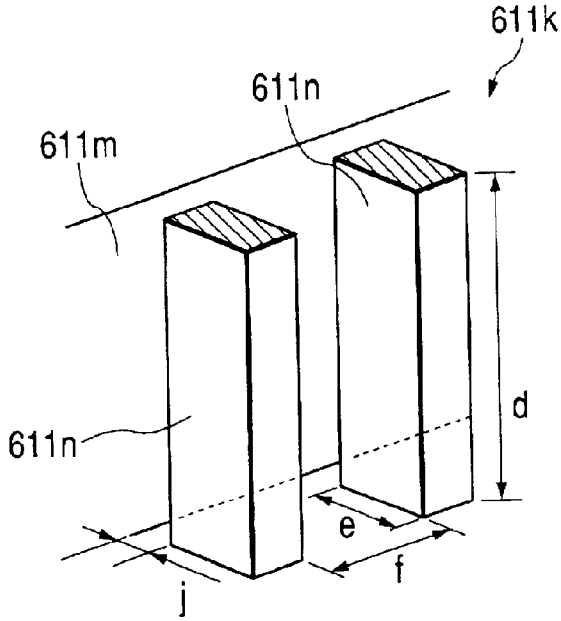
FIGS. 16 to 22 are perspective views showing other examples of the groove structure applicable to the present invention.

On the other hand, let us consider a recessed groove structure 611*k* as shown in FIG. 16, having a height d, a depth e and an aperture width f and composed of two rectangular pillars 611*n* in a position separated by a distance j from a wall portion 611*m*. Applying the equation (1) to such structure, there can be obtained:

$$hi = (2e)/ef \times (T\cos\theta/pg) \quad (3)$$

$$= 2/f \times (T\cos\theta/pg)$$

Based on the foregoing, hi is proportional to a constant A=L/S unless the contact angle of the ink in the groove structure is varied.

FIGS. 17 to 22 show variations in the shape of the groove structure.

Figure 17:
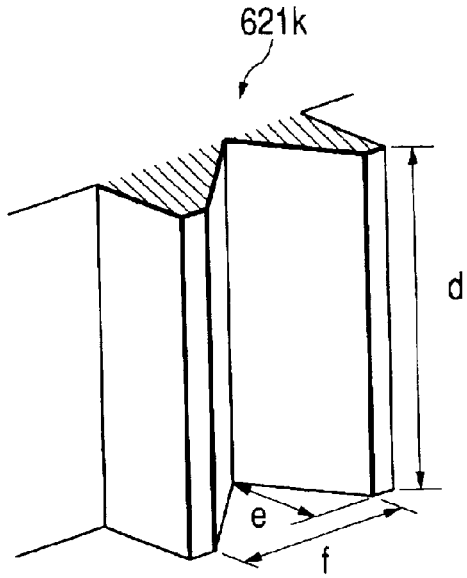
Figure 18:
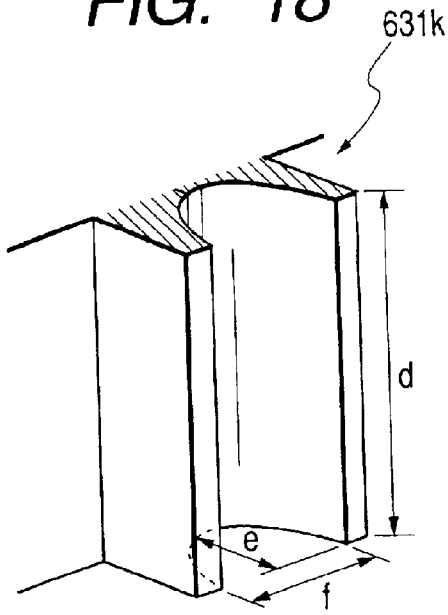
Figure 19:
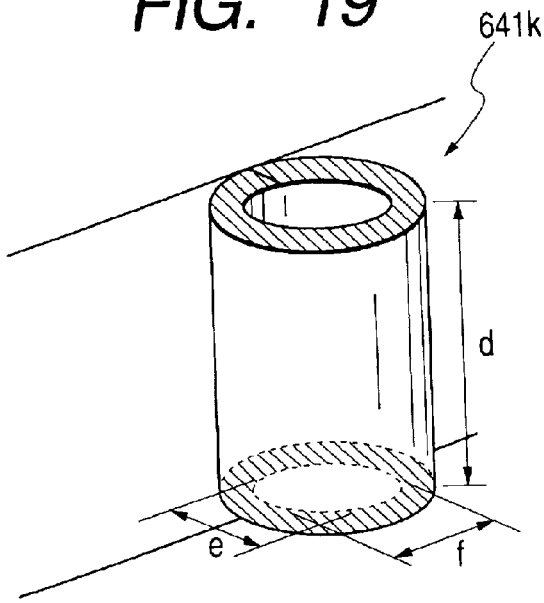
Figure 20:
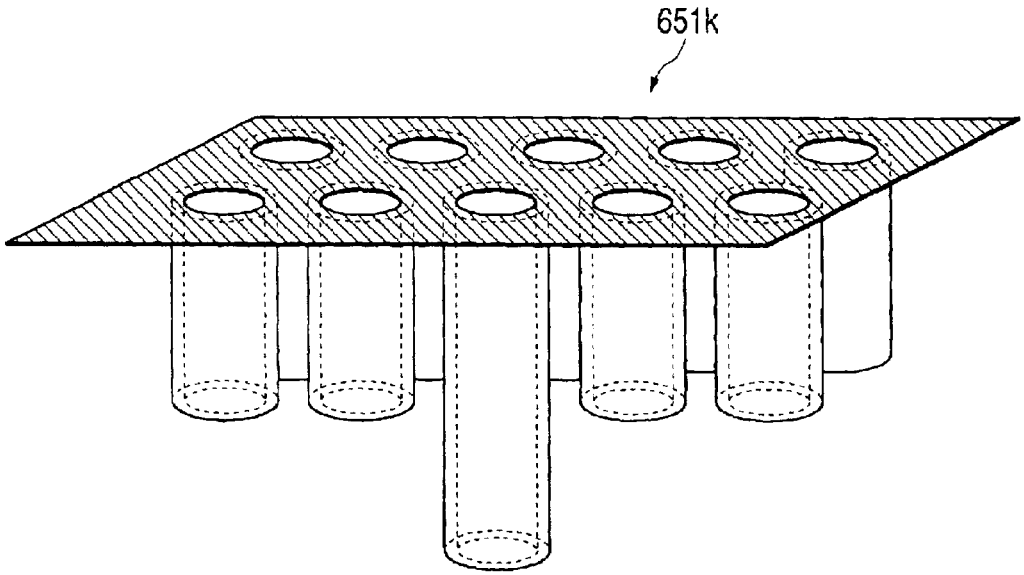
Figure 21:
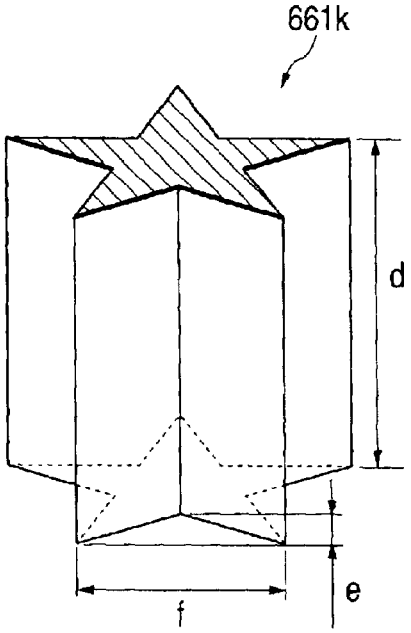
Figure 22:
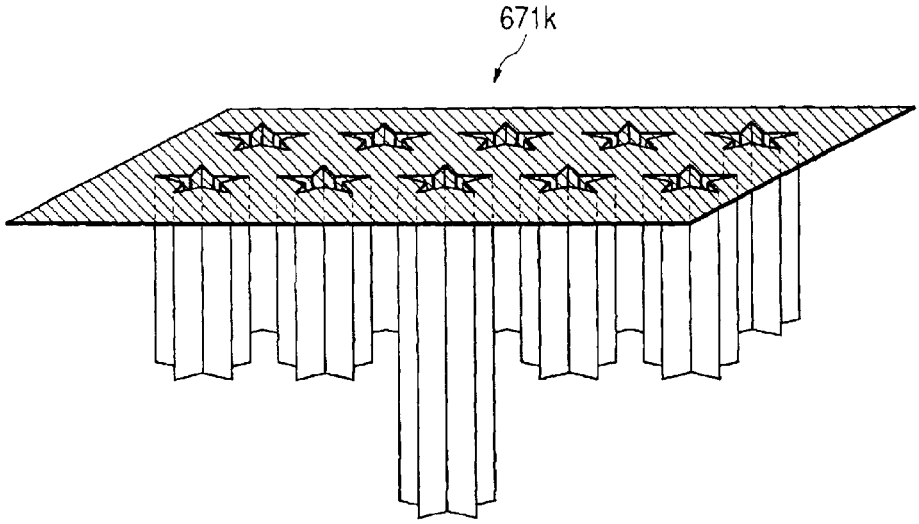

A groove structure 621*k* shown in FIG. 17 has a groove shape of wedge-shaped cross section. A groove structure 631*k* shown in FIG. 18 has a groove shape of semi-oval cross section. A groove structure 641*k* shown in FIG. 19 is cylindrical, of which hollow portion serves to hold the ink by surface tension. A groove structure 661*k* shown in FIG. 21 has a star-shaped cross section, and a portion where ink contact faces mutually cross at an acute angle serves to hold the ink by the surface tension. The groove structure 661*k* having the star-shaped cross section can be considered as a group of wedge-shaped groove structures, and the depth e and the aperture width f are defined in the recessed portion. Also FIGS. 20 and 22 show groove structures 651*k*, 671*k* formed as a component including plural holes (hollow portions) of circular or star-shaped cross section. A structure for contacting the ink with the lower surface of the filter can also be formed by placing a component as shown in FIG. 20 or 22 immediately under the filter. In the foregoing there have been explained various forms of the groove structure, and the shape, number, installing position and combination of such groove structure can be arbitrarily changed within a range not departing from the scope of the present invention.

Table 2 shows the ink lifting height hi (maximum height of groove structure) in some of the aforementioned variations, with a depth e=2 mm, in which the constant A and the aperture width f is changed from 0.3 mm to 2.0 mm by every 0.2 mm.

TABLE 2

| Shape of groove structure | A ($m^{-1}$) | Aperture width f (mm) 0.3 | 0.5 | 0.8 | 1.0 | 1.2 | 1.4 | 1.6 | 1.8 | 2.0 |
|---|---|---|---|---|---|---|---|---|---|---|
| Wedge type | 5099 | 40 | 24 | 15 | 12 | 10 | 9 | 8 | 7 | 7 |
| Semi-oval type | 3808 | 29 | 17 | 11 | 9 | 8 | 7 | 7 | 6 | 6 |
| Recessed type | 3000 | 21 | 13 | 9 | 7 | 6 | 6 | 5 | 5 | 4 |
| Rectangular pillar type | 1000 | 20 | 12 | 7 | 6 | 5 | 4 | 4 | 3 | 3 |

In the groove structure of "rectangular pillar type", the value A is determined for an aperture width b=1.6 mm. Also in the "semi-oval type", the depth e is defined as a half of the longer diameter and the aperture width f is defined as the shorter diameter.

Figure 23:
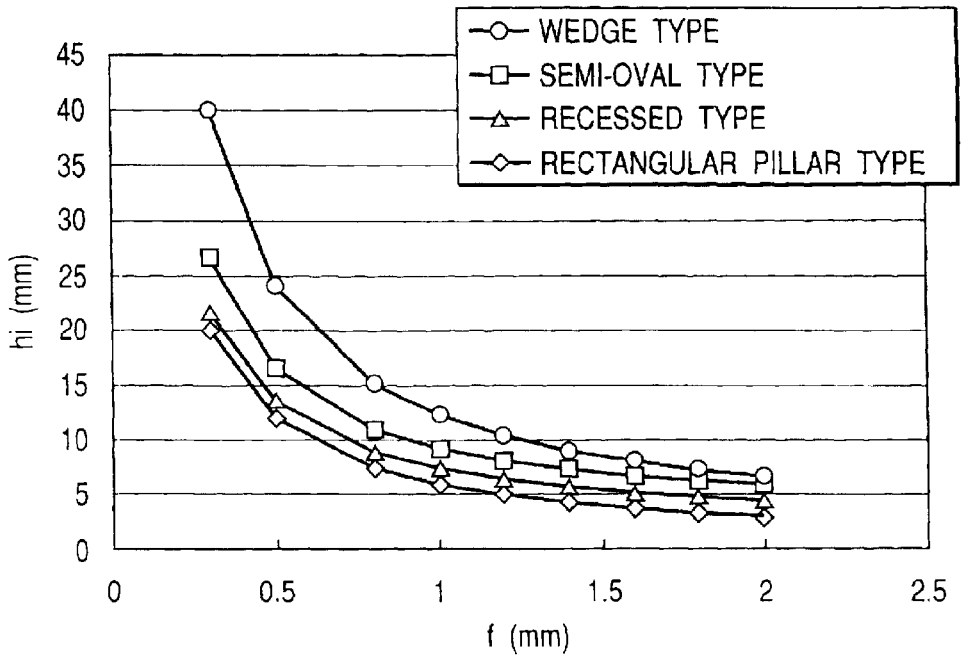
FIG. 23 is a chart showing the relationship between an aperture width and an ink elevation height in various forms of the groove structure applicable to the present invention.

FIG. 23 is a chart showing the relationship between the aperture width f and the ink lifting height hi. Referring to FIG. 23, in the "rectangular pillar type", the ink lifting height hi is 3 mm for f=2.0 mm and 4 mm for f=1.6 mm. The value hi=3 mm corresponds to a gas thickness at least required in the gas holding area under the filter. Also in consideration of the dimensional fluctuation in the components, there is required hi=4 mm. The constant A in such state is A=1250 $m^{-1}$. As indicated by the equation (3), the depth of the groove structure of "rectangular pillar type" does not influence the ink lifting height, so that the constant A of such structure can be considered as the lower limit of that in other groove structures influenced by the depth. Thus, if the gas in the gas holding area is thicker, there can be employed the groove structure of "wedge" or "recessed" type with a small aperture width f. Therefore, in order to realize the present invention, the constant A is preferably at least equal to 1000 $m^{-1}$, more preferably at least equal to 1250 $m^{-1}$.

A small bubble, if trapped in a corner portion of the groove structure, hinder the ink movement in the groove structure. In order to avoid such bubble trapping, the ink moving portion of the groove structure and the vicinity thereof is preferably cut off or rounded at the edge. Also the corner portion of the filter is preferably cut off or rounded in order to prevent bubble trapping in such portion.

(Liquid Chamber Cover)

Figure 24:
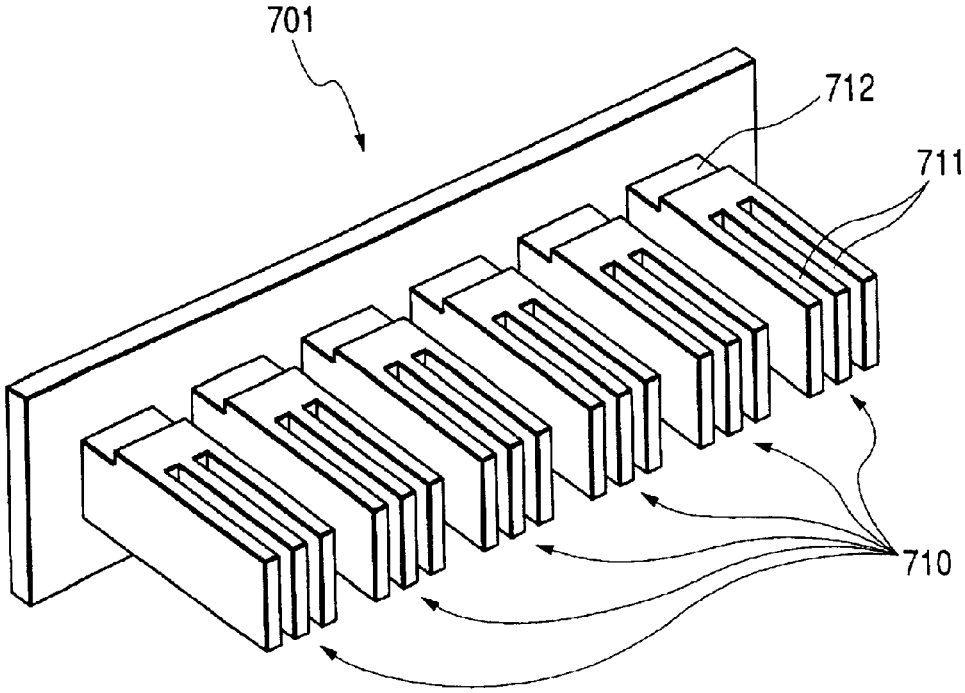
FIG. 24 is a perspective view of a cover member constituting the groove structure of the present invention.
Figure 25:
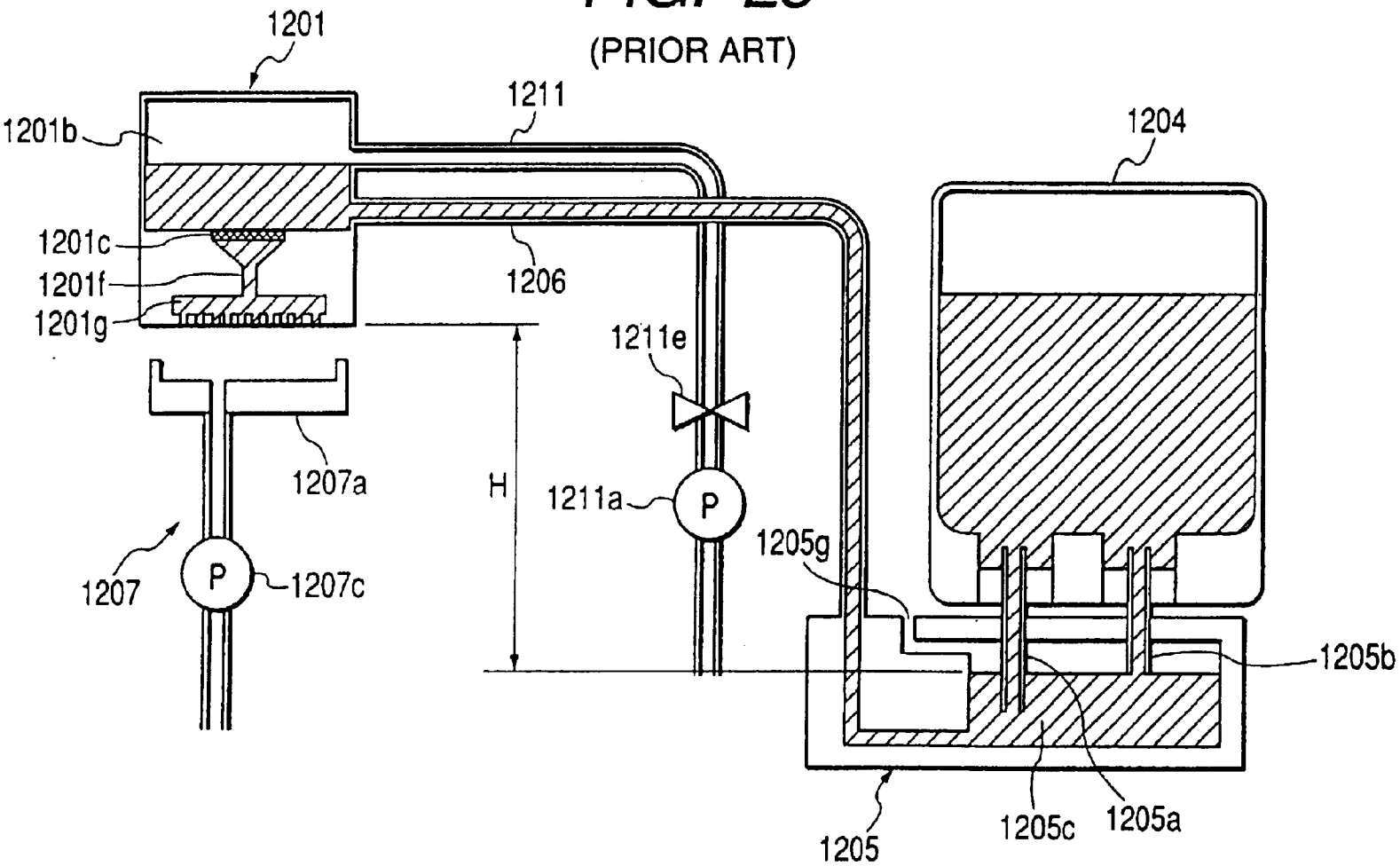
FIG. 25 (PRIOR ART)
FIG. 25 is a view showing an ink supply system in an ink jet recording apparatus of conventional tube supply system.

As shown in FIG. 10, a lateral face of the liquid chamber 301*f* may be composed of a cover member 701 separate from other portions. In the example shown in FIG. 10, the cover member 701 constitutes a face where the groove structure 301*j* is provided. FIG. 24 is a perspective view of such cover member 701.

As shown in FIG. 24, the liquid chamber cover 701 is provided, on a face thereof constituting the internal wall of the liquid chamber 301*f* (cf. FIG. 10), with grooves structures 710 having vertical slits 711 in protruding manner and in a number corresponding to the number of the liquid chambers 301*f*. Thus, in a state where the liquid chamber cover 701 is jointed to the main body 720 (cf. FIG. 10) constituting the main part of the liquid chamber 301*f*, the groove structures 710 are positioned in the respectively corresponding liquid chambers 301*f*. The vertical slit 711 serves as a structure for holding the ink in the liquid chamber 301*f* by the surface tension. Also at the base portion of each groove structure, there is formed a lateral slit 712. On the other hand, in case a face of the liquid chamber main body 720 where the liquid chamber cover 701 is to be jointed also constitutes a part of a lateral face of the liquid chamber 301*f* in combination with the liquid chamber cover 701, such face of the liquid chamber main body 720 is also provided with slits matching the vertical slit 711 and the lateral slit 712 of the groove structure 710 of the liquid chamber cover 701. The groove structure 710 of the liquid chamber cover 701 and the slits of the liquid chamber main body 720 constitute the liquid chamber groove structure 301*j* (cf. FIG. 10). The groove structures 710 of the liquid chamber cover may be mutually different in the respectively different liquid chambers 301*f*.

In the following there will be explained the jointing process for the liquid chamber main body 720 and the liquid chamber cover 701 in case of jointing with adhesive, with reference to FIGS. 10 and 24.

A particle such as dust present in the liquid chamber 301*f* may move the nozzle 301*g* and cause clogging thereof. In order to prevent such situation, the liquid chamber main body 720 and the liquid chamber cover 701 are sufficiently rinsed with alkali, solvent or purified water prior to the jointing of the liquid chamber cover 701. Then adhesive is applied on a joint face of the liquid chamber main body 720 with the liquid chamber cover 701. It is necessary to avoid particle generation also in this step. The present embodiment employs heat settable adhesive of epoxy type but any adhesive capable of resisting ink and providing sufficient sealing and adhesion strength may be employed. Then the cover 701 is pressed to the liquid chamber main body 720 and the adhesive is set by heating in a heating oven. In the present embodiment, the heat setting was executed for 5 hours at 105° C.

After the pressing of the liquid chamber cover 701, when the temperature is raised in the heating over, the viscosity of the adhesive temporarily lowers and the adhesive starts to flow. If the vertical slit 711 of the liquid chamber cover 701 is close to the jointing face, the flowing adhesive may enter and fill the vertical slit 711. In the present embodiment, the intrusion of the adhesive into the vertical slit 711 can be prevented by forming the groove structure 710 in such a manner that the vertical slit 711 protrudes from the jointing face of the liquid chamber cover 701. The experiment of the present inventors confirmed that the flowing adhesive did not enter the vertical slit 711 if the base portion thereof protrudes by 2 mm or greater from the jointing face of the liquid chamber cover 701. Also by forming lateral slit 712 at the base portion of the groove structure 710, the flowing adhesive can be retained in such lateral slit 712 whereby more effectively reducing the movement of the adhesive to the vertical slit 711.

In the foregoing, the present invention has been explained by preferred embodiments thereof, but the present invention is not limited to such embodiments and is applicable to various liquid supply systems adapted to hold liquid in the negative pressure state and including the liquid supply path having a filter therein.

Also in the application of such liquid supply system to the ink jet recording apparatus, the ink supply system to the recording head is not limited to the tube supply system explained in the foregoing embodiments but can also be the pin-in system, with similar effects. It is also applicable to the recording head of head tank integral system, by using the sub tank as the main ink tank. In such case, the recording head of head tank integral type itself is constituted as the ink supply system. More specifically, the sub tank is provided with an air communicating aperture to be opened or closed by an unrepresented valve mechanism, and, at the ink filling into the liquid chamber, such air communicating aperture is closed and the interior of the recording head is reduced to a desired pressure by the suction from the nozzle, and then the air communicating aperture is opened, whereby an appropriate amount of ink is supplied into the liquid chamber.

Also in the foregoing embodiments, there have been explained the ink jet recording apparatus of serial scan type, but the present invention is likewise applicable to an ink jet recording apparatus mounted with an ink jet recording head of line type, having the nozzle array over the entire width of the recording medium.

As explained in the foregoing, the present invention provides the configuration in which the filter and the liquid are separated by gas of the gas holding area at the downstream side of the filter, thereby avoiding the drawback, in case the bubble is generated at the downstream side of the filter, in the liquid supply from the upstream side of the filter to the downstream side thereof, induced by such bubble. Particularly in the ink jet recording head and in the ink jet recording apparatus, it is rendered possible to prevent defective ink discharge resulting from the deficient ink supply to the downstream side of the filter, thereby significantly improving the reliability on the ink discharge. Also at the downstream side of the side, there is provided a structure for holding the liquid, present at the downstream side of the film across the gas of the gas holding area, by the surface tension for connecting such liquid with the liquid at the upstream side of the filter, or a liquid chamber for so holding the liquid as to contact it with a part of the downstream face of the filter, whereby the liquid held in the downstream side of the filter can escape to the upstream side through the filter in case of inflation of the gas in the gas holding area, so that the unexpected liquid flow-out from the downstream end of the liquid supply path or from the discharge portion in case of the ink jet recording head.

Also the liquid filling method of the present invention allows to fill the first and second liquid chambers with the liquid of respectively appropriate amounts even in case the liquid amounts therein decrease by the gas accumulation therein.

What is claimed is:

1. A liquid supply system which is provided with a liquid supply path to a liquid holding portion holding liquid at the downstream end in the supply direction of liquid and a filter in the liquid supply path and in which the liquid can be supplied from the upstream side of the filter to the downstream side thereof in the vertical direction in the direction of gravity, the system comprising:

a member for dividing a portion downstream of the filter into a gas holding area and a liquid holding area, wherein the gas held in said gas holding area is in communication with gas present between the downstream side of the filter and the liquid holding portion in said downstream end.

2. A liquid supply system according to claim 1, wherein the gas held in said gas holding area communicates with the liquid in said liquid holding portion thereby enabling reversible movement of the liquid at the upstream side of said filter and the liquid at the downstream side of said filter.

3. A liquid supply system according to claim 1, wherein the gas present between the downstream side of said filter and the upstream side of the liquid holding portion at said downstream end is so positioned as to inhibit movement of a bubble from said liquid holding portion to said filter.

4. A liquid supply system according to claim 1, further comprising:

a liquid connection structure, for holding, at the downstream side of said filter in said liquid supply path, the liquid present at the downstream side of said filter across the gas of said gas holding area by the surface tension of said liquid and connecting said liquid with the liquid at the upstream side of said filter.

5. A liquid supply system according to claim 4, wherein said liquid connecting structure includes a groove-shaped structure portion which is provided along the vertical direction and of which the upper end is almost in contact with the face of said filter at the downstream side thereof.

6. A liquid supply system according to claim 5, wherein the gap between said groove-shaped structure portion and said filter is within a range of 0 S t S 1.0 mm.

7. A liquid supply system according to claim 5, wherein said groove-shaped structure portion has a cross section of recessed shape.

8. A liquid supply system according to claim 5, wherein said groove-shaped structure portion has a cross section of wedge shape.

9. A liquid supply system according to claim 5, wherein said groove-shaped structure portion has an arc-shaped liquid holding surface.

10. A liquid supply system according to claim 5, wherein said groove-shaped structure portion has a member in which plural hollowing portions for holding liquid are formed, and said member is provided at the downstream side of said filter.

11. A liquid supply system according to claim 5, wherein said groove-shaped structure portion satisfies a relation $L/S \geqq 1000$ wherein L is the circumferential length of an area in contact with the liquid in said groove-shaped structure portion and S is the cross section of an area in contact with the liquid in said groove-shaped structure portion.

12. A liquid supply system according to claim 5, wherein surrounding portion of said groove-shaped structure portion is cut off or rounded.

13. A liquid supply system according to claim 5, wherein said groove-shaped structure portion is integrally constructed with a member constituting said liquid supply path at the downstream side of said filter.

14. A liquid supply system according to claim 5, wherein, at the downstream side of said filter, said liquid supply path includes a cover member constituting a lateral face of said liquid supply path and a main body member constituting another face of said liquid supply path and jointed to said cover member, and said groove-shaped structure portion is provided at least on said cover member.

15. A liquid supply system according to claim 14; wherein said cover member and said main body member are jointed with adhesive, and the groove-shaped structure portion provided on said cover member is provided as a protruding portion with a slit, protruding from the adhered face of said cover member with said main body member and holding the liquid by the surface tension thereof.

16. A liquid supply system according to claim 15, wherein said protruding portion is provided with a groove for receiving said adhesive between the adhered face of said cover member with said main body member and said slit.

17. A liquid supply system according to any of claims 1 to 16, wherein said liquid supply path has a first liquid chamber at the upstream side of said filter and a second liquid chamber including the gas of said gas holding area at the downstream side of said filter.

18. A liquid supply system according to claim 17, wherein said first liquid chamber includes pressure adjusting means for absorbing pressure variation in said first liquid chamber.

19. A liquid supply system according to claim 17, further comprising, at the upstream side of said first liquid chamber in said liquid supply path, a valve structure to be opened at the normal liquid supply state and to be closed at the liquid filling into said second liquid chamber by suction from said downstream end.

20. A liquid supply system according to claim 17, wherein said first liquid chamber includes an air communication aperture which can be opened and closed and is to be closed at the liquid filling into said second liquid chamber by suction from said downstream end.

21. A liquid supply system according to claim 17, further comprising, at the downstream side of said filter in said liquid supply path, a third liquid chamber for holding the liquid in such a manner that the liquid is in contact with a part of the surface of said filter at the downstream side thereof.

22. A liquid supply system according to claim 21, wherein said third liquid chamber includes a structure for holding the liquid by the surface tension thereof in contact with the surface of said filter at the downstream side thereof.

23. A liquid supply system according to claim 22, wherein the structure for causing the liquid of said third liquid chamber to contact the surface of said filter at the downstream side thereof includes at least a rib so provided that the front end thereof is in contact with the surface of said filter at the downstream side thereof.

24. A liquid supply system according to claim 21, wherein the amount of the liquid that can be held in said third liquid chamber is larger than the amount of change in the volume of the gas in said gas holding area anticipated in the environment of use.

25. A liquid supply system according to claim 21, wherein said third liquid chamber is so provided as to surround an aperture connecting said filter and said second liquid chamber.

26. An ink jet recording head provided with a first liquid chamber and a second liquid chamber separated by a filter and respectively containing liquid therein, and a liquid discharge portion connected directly with said second liquid chamber and adapted to discharge the liquid supplied from said second liquid chamber, in which the liquid can be supplied from said first liquid chamber to said second liquid chamber through said filter, comprising:

a member for dividing a portion downstream of the filter in contact with said second liquid chamber into a gas holding area and a liquid holding area, wherein the gas held in said gas holding area is in communication with the gas present in said second liquid chamber.

27. An ink jet recording head according to claim 26, wherein the liquid held in said liquid holding area communicates with the liquid in said liquid chamber thereby enabling reversible movement of the liquid in said first liquid chamber and the liquid in said second liquid chamber.

28. An ink jet recording head according to claim 26, wherein the gas present in said gas holding area is so positioned as to inhibit movement of a bubble from said liquid discharge portion to said filter.

29. An ink jet recording head according to claim 26, further comprising a liquid connection structure for holding the liquid present in said second liquid chamber across the gas of said gas holding area by the surface tension of said liquid and connecting said liquid, with the liquid in said first liquid chamber through said filter.

30. An ink jet recording head according to claim 29, wherein said liquid connecting structure includes a groove-shaped structure portion which is provided along the liquid supply direction from said first liquid chamber to said second liquid chamber and of which the upper end is almost in contact with the surface of said filter at the downstream side thereof.

31. An ink jet recording head according to claim 30, wherein the gap between said groove-shaped structure portion and said filter is within a range of $0 \leqq t \leqq 1.0$ mm.

32. An ink jet recording head according to claim 30, wherein said groove-shaped structure portion has a cross section of recessed shape.

33. An ink jet recording head according to claim 30, wherein said groove-shaped structure portion has a cross section of wedge shape.

34. An ink jet recording head according to claim 30, wherein said groove-shaped structure portion has an arc-shaped liquid holding surface.

35. An ink jet recording head according to claim 30, wherein said groove-shaped structure portion has a member in which plural hollowing portions for holding liquid are formed, and said member is provided at the downstream side of said filter.

36. An ink jet recording head according to claim 30, wherein said groove-shaped structure portion satisfies a relation $L/S \geqq 1000$ wherein L is the circumferential length of an area in contact with the liquid in said groove-shaped structure portion and S is the cross section of an area in contact with the liquid in said groove-shaped structure portion.

37. An ink jet recording head according to claim 30, wherein surrounding portion of said groove-shaped structure portion is cut off or rounded.

38. An ink jet recording head according to claim 30, wherein said groove-shaped structure portion is integrally constructed with a member constituting said second liquid chamber.

39. An ink jet recording head according to claim 30, wherein said second liquid chamber includes a cover member constituting a lateral face of said second liquid chamber and a main body member constituting another face of said second liquid chamber and jointed to said cover member, and said groove-shaped structure portion is provided at least on said cover member.

40. An ink jet recording head according to claim 39, wherein said cover member and said main body member are jointed with adhesive, and the groove-shaped structure portion provided on said cover member is provided as a protruding portion with a slit, protruding from the adhered face of said cover member with said main body member and holding the liquid by the surface tension thereof.

41. An ink jet recording head according to claim 40, wherein said protruding portion is provided with a groove for receiving said adhesive between the adhered face of said cover member with said main body member and said slit.

42. An ink jet recording head according to claim 26, wherein said first liquid chamber includes pressure adjusting means for absorbing pressure variation in said first liquid chamber.

43. An ink jet recording head according to claim 26, further comprising a connecting portion to which a liquid supply means to said first liquid chamber is detachably connected.

44. An ink jet recording head according to claim 26, further comprising, between said first liquid chamber and said second liquid chamber, a third liquid chamber for holding the liquid in such a manner that the liquid is in contact with a part of the surface of said filter at the side of said second liquid chamber.

45. An ink jet recording head according to claim 44, wherein said third liquid chamber includes a structure for holding the liquid by the surface tension thereof in contact with the surface of said filter.

46. An ink jet recording head according to claim 45, wherein the structure for causing the liquid of said third liquid chamber to contact the surface of said filter includes at least a rib so provided that the front end thereof is in contact with the surface of said filter at the side of said second liquid chamber.

47. An ink jet recording head-according to claim 44, wherein the amount of the liquid that can be held in said third liquid chamber is larger than the amount of change in the volume of the gas in said gas holding area anticipated in the environment of use.

48. An ink jet recording head according to claim 44, wherein said third liquid chamber is so provided as to surround an aperture connecting said filter and said second liquid chamber.

49. A liquid filling method for use in a liquid supply system in which first and second liquid chambers respectively holding liquid are separated by a filter while liquid is held at the downstream side of said second liquid chamber in the liquid supply direction from said first liquid chamber to said second liquid chamber, a member is provided for separating a contact portion of the downstream side of said filter into a gas holding area and a liquid holding area in a state capable of liquid supply from the upstream side of said filter to the downstream side thereof in the vertical direction of gravity, and the gas held in said gas holding area is in communication with the gas present between the downstream side of said filter and the upstream side of the second liquid chamber, the method comprising:

a step of closing the first liquid chamber from the exterior;

a step of executing suction from the downstream side of said second liquid chamber in a state where said first liquid chamber is closed, thereby reducing the pressure of said first and second liquid chambers; and a step, after the pressure reduction of said first and second liquid chambers, of opening said first liquid chamber to the exterior.

* * * * *

UNITED STATES PATENT AND TRADEMARK OFFICE

CERTIFICATE OF CORRECTION

PATENT NO. : 6,805,437 B2
DATED : October 19, 2004
INVENTOR(S) : Akihiro Yamanaka et al.

It is certified that error appears in the above-identified patent and that said Letters Patent is hereby corrected as shown below:

Column 1,
Line 16, “now” should read -- low --; and
Line 30, “with” should read -- width --.

Column 3,
Line 54, “clossing” should read -- clogging --.

Column 31,
Line 29, “over,” should read -- oven, --.

Column 33,
Line 7, “gap” should read -- gap t --; and
Line 8, “OstS1.0mm.” should read -- $0 \leq t \leq 1.0$ mm. --.

Column 34,
Line 66, “gap” should read -- gap t --.

Column 36,
Line 18, “head-according” should read -- head according --.

Signed and Sealed this

Twenty-third Day of August, 2005

JON W. DUDAS
*Director of the United States Patent and Trademark Office*